US011007623B2

(12) United States Patent
Francis

(10) Patent No.: US 11,007,623 B2
(45) Date of Patent: May 18, 2021

(54) CYLINDER VICE

(71) Applicant: John Francis, Ogden, UT (US)

(72) Inventor: John Francis, Ogden, UT (US)

( * ) Notice: Subject to any disclaimer, the term of this patent is extended or adjusted under 35 U.S.C. 154(b) by 146 days.

(21) Appl. No.: 16/021,341

(22) Filed: Jun. 28, 2018

(65) Prior Publication Data

US 2019/0070712 A1 Mar. 7, 2019

Related U.S. Application Data

(60) Provisional application No. 62/527,576, filed on Jun. 30, 2017.

(51) Int. Cl.

| | |
|---|---|
| ***B25B 1/18*** | (2006.01) |
| ***B25B 1/02*** | (2006.01) |
| ***B25B 1/20*** | (2006.01) |
| ***F15B 15/14*** | (2006.01) |
| ***F15B 15/24*** | (2006.01) |

(52) U.S. Cl.

CPC ..... *B25B 1/18* (2013.01); *B25B 1/02* (2013.01); *B25B 1/205* (2013.01); *F15B 15/14* (2013.01); *F15B 15/1476* (2013.01); *F15B 15/24* (2013.01)

(58) Field of Classification Search

CPC .. B25B 1/18; B25B 1/02; B25B 1/205; B25B 1/20; B25B 1/2405; B25B 1/00; B25B 5/14; B25B 5/147; B25B 5/00; B25B 11/02; B25B 11/00; F15B 15/14; F15B 15/24; F15B 15/1476; E04B 2001/2415; E04B 2001/2644

USPC ..... 269/24–27, 32, 55, 71

See application file for complete search history.

(56) References Cited

U.S. PATENT DOCUMENTS

| | | | | |
|---|---|---|---|---|
| 2,968,978 A * | 1/1961 | Wheeler | B25B 1/205 | 269/130 |
| 3,805,646 A * | 4/1974 | Knight | B25B 13/52 | 81/69 |
| 8,590,876 B1 * | 11/2013 | Madson | B25B 5/147 | 269/130 |

* cited by examiner

*Primary Examiner* — Lee D Wilson
*Assistant Examiner* — Seahee Hong
(74) *Attorney, Agent, or Firm* — Maschoff Brennan

(57) ABSTRACT

A cylinder vice includes a vice jaw, a chain retainer, and a hydraulic assembly. The vice jaw is positioned between side braces and include outer and inner plates. The outer plates include a top edge having a V-shape geometry. The outer plates include a female slide configured to interface with a male slide of the side braces. The inner plates include a top edge having another V-shape geometry. The inner plates include a bottom edge that is configured to interface with a piston. The chain retainer configured to retain a chain end positioned in a slot configuration of the chain retainer and fastened via retainer handles. The chain retainer includes a handle on each side of the slot configuration such that each handle is positioned in the notches of the side braces. The hydraulic assembly is configured to actuate the piston against the bottom edge of the inner plates.

1 Claim, 24 Drawing Sheets

CYLINDER VICE

CROSS-REFERENCE TO RELATED APPLICATIONS

This application claims priority to U.S. Provisional Application No. 62/527,576, filed Jun. 30, 2017, titled CYLINDER VICE, which incorporated herein by reference in its entirety.

FIELD

The embodiments described herein are related to vices. In particular, some embodiments are related to vices that are configured for retaining cylindrical structures.

BACKGROUND

Hydraulic cylinders are prevalent in many industries such as construction, manufacturing, and civil engineering. Periodically, hydraulic cylinders are assembled, disassembled, and maintained. During such assembly, disassembly, and maintenance processes, retaining the hydraulic cylinder is difficult without deviation of the hydraulic cylinder.

The subject matter claimed herein is not limited to embodiments that solve any disadvantages or that operate only in environments such as those described above. Rather, this background is only provided to illustrate one area where some embodiments described herein may be practiced.

SUMMARY

A cylinder vice may include a tower, a first plurality of gussets, a second plurality of gussets, a retainer ring, a vice plate, side braces, a male slide, a plurality of notches, a top edge, a vice jaw, a chain retainer, and a hydraulic assembly. The tower may be configured to be fixed at a bottom side to a base plate, and the tower may be configured to be fixed at a top side to a top plate. The first plurality of gussets may be configured to attach a bottom portion of the tower to the base plate. The second plurality of gussets may be configured to attach a top portion of the tower to the top plate. The retainer ring may be configured to be positioned concentric to the top plate. The vice plate may be configured to be positioned above the retainer ring and the top plate. The vice plate may be configured to be fastened to the retainer ring and the top plate when fastened with a retainer clamp. The vice plate may be configured to swivel about a central axis of the tower when not fastened with the retainer clamp to the retainer ring and the top plate. The side braces may include a male slide on each internal face of the side braces, a plurality of notches on each side edge of the side braces, each notch of the plurality of notches angled downward and including a radial face; and a top edge on each of the side braces, the top edge having a first V-shape geometry such that a cylindrical structure is permitted to rest on the top edge without movement. The vice jaw may be positioned between the side braces and may include outer plates and inner plates. The outer plates may include a top edge having a second V-shape geometry. Each of the outer plates may include a female slide configured to interface with the corresponding male slide of the side braces. The inner plates may include a top edge having a third V-shape geometry. The inner plates may include a bottom edge that is configured to interface with a piston. The bottom edge may be substantially perpendicular to the piston. The second V-shape geometry and the third V-shape geometry may be symmetrical relative to each other. The chain retainer may be configured to retain a chain end of a chain. The chain end may be positioned in a slot configuration of the chain retainer and fastened to the chain retainer via a retainer handles. The chain retainer may include a handle on each side of the slot configuration such that each handle may be configured to be positioned in one of the notches of the side braces. The hydraulic assembly may be configured to actuate the piston against the bottom edge of the inner plates of the vice jaw such that the vice jaw applies a positive amount of work to the cylindrical structure. The cylindrical structure may be configured to be simultaneously bound on a top portion by the chain. The hydraulic assembly may include a spring and a limiter. The spring may be configured to aid the piston to return to a beginning of a piston stroke. The limiter may be configured to limit the piston stroke.

The object and advantages of the embodiments will be realized and achieved at least by the elements, features, and combinations particularly pointed out in the claims.

It is to be understood that both the foregoing general description and the following detailed description are exemplary and explanatory and are not restrictive of the invention, as claimed.

BRIEF DESCRIPTION OF THE DRAWINGS

Example embodiments will be described and explained with additional specificity and detail through the use of the accompanying drawings in which.

DESCRIPTION OF EMBODIMENTS

A cylinder vice as described in the present disclosure may permit a more efficient, safe work experience when working on hydraulic cylinders. The size, weight, filth, and pressurization of the hydraulic cylinders often presents a challenging task for individuals who work on hydraulic cylinders. In one or more embodiments, the cylinder vice may have the capacity and strength to place one of the hydraulic cylinders in a fixed, substantially immovable state while maintaining certain safety, ergonomic, and spatial footprint considerations.

Figure 1A:
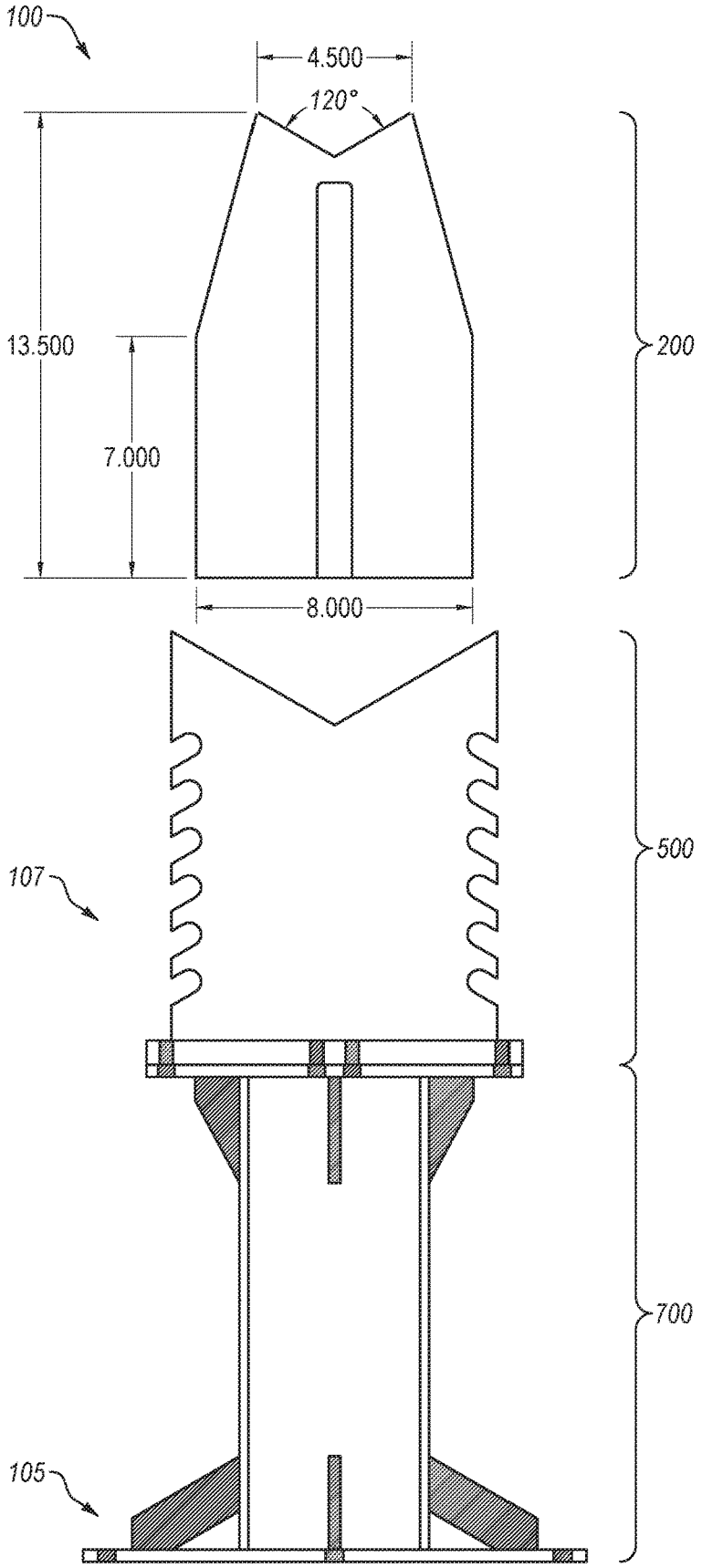
FIG. 1A illustrates an example cylinder vice.
Figure 1B:
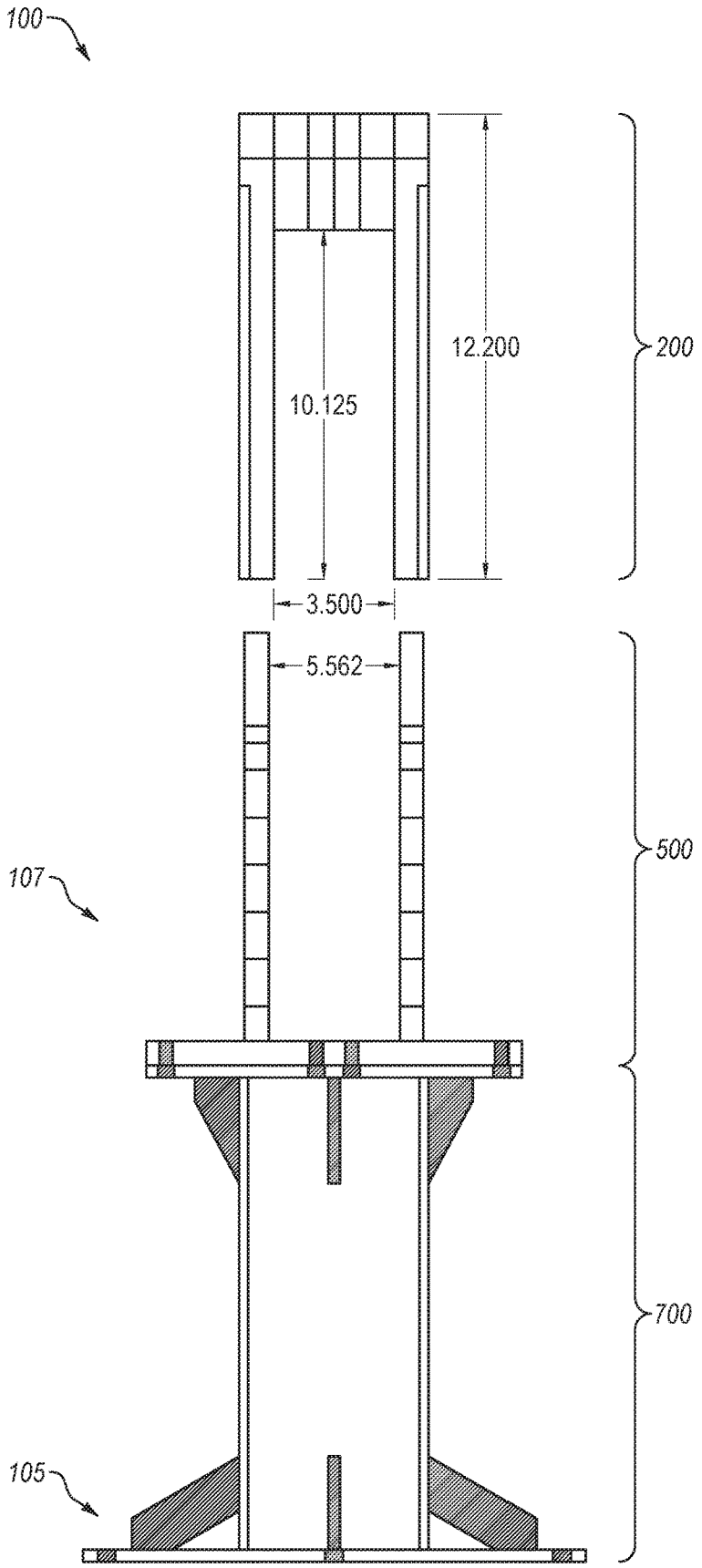
FIG. 1B is another view of the cylinder vice of FIG. 1A.
Figure 1C:
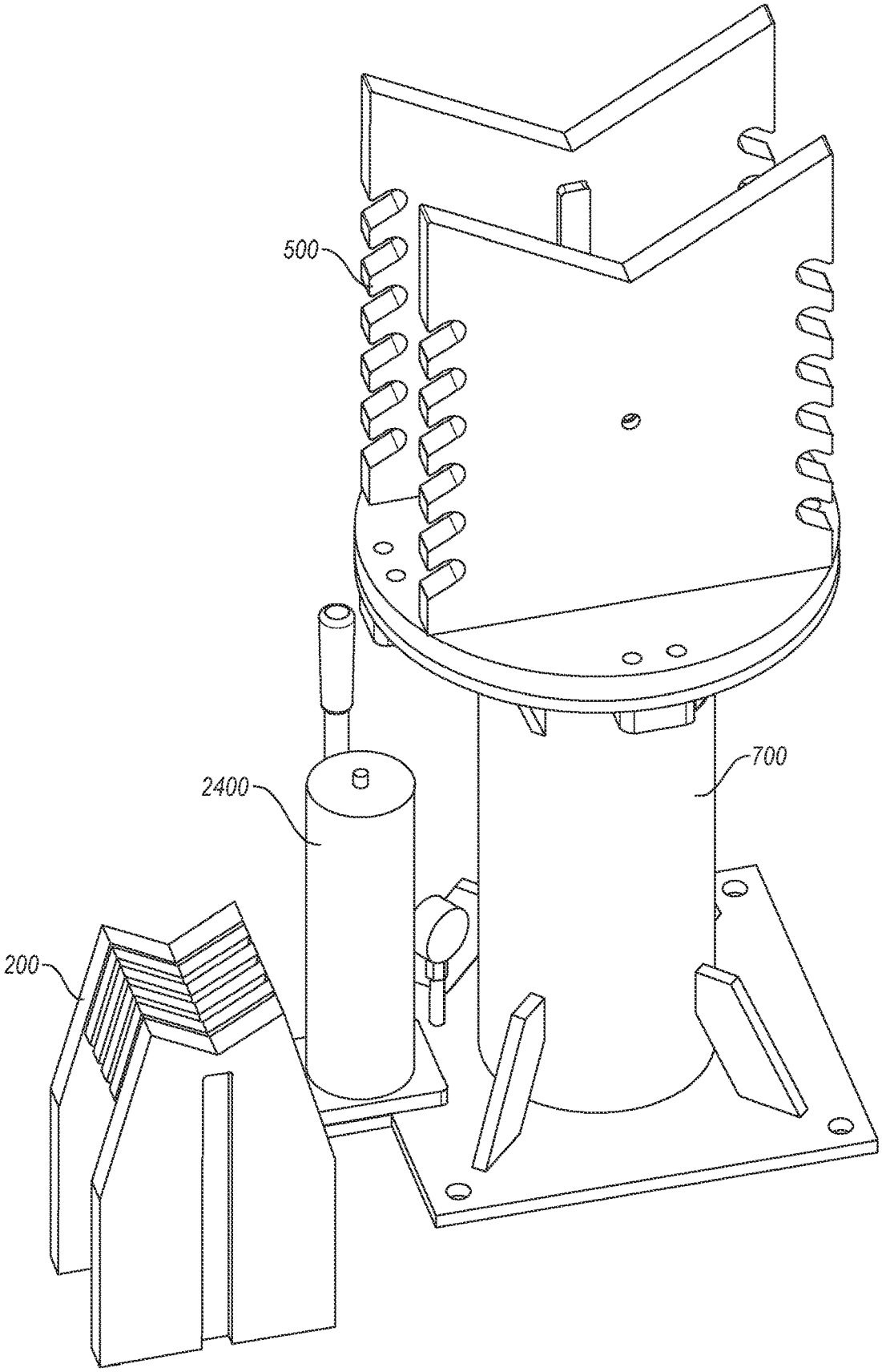
FIG. 1C is an image depicting another view of the cylinder vice of FIG. 1A.
Figure 1D:
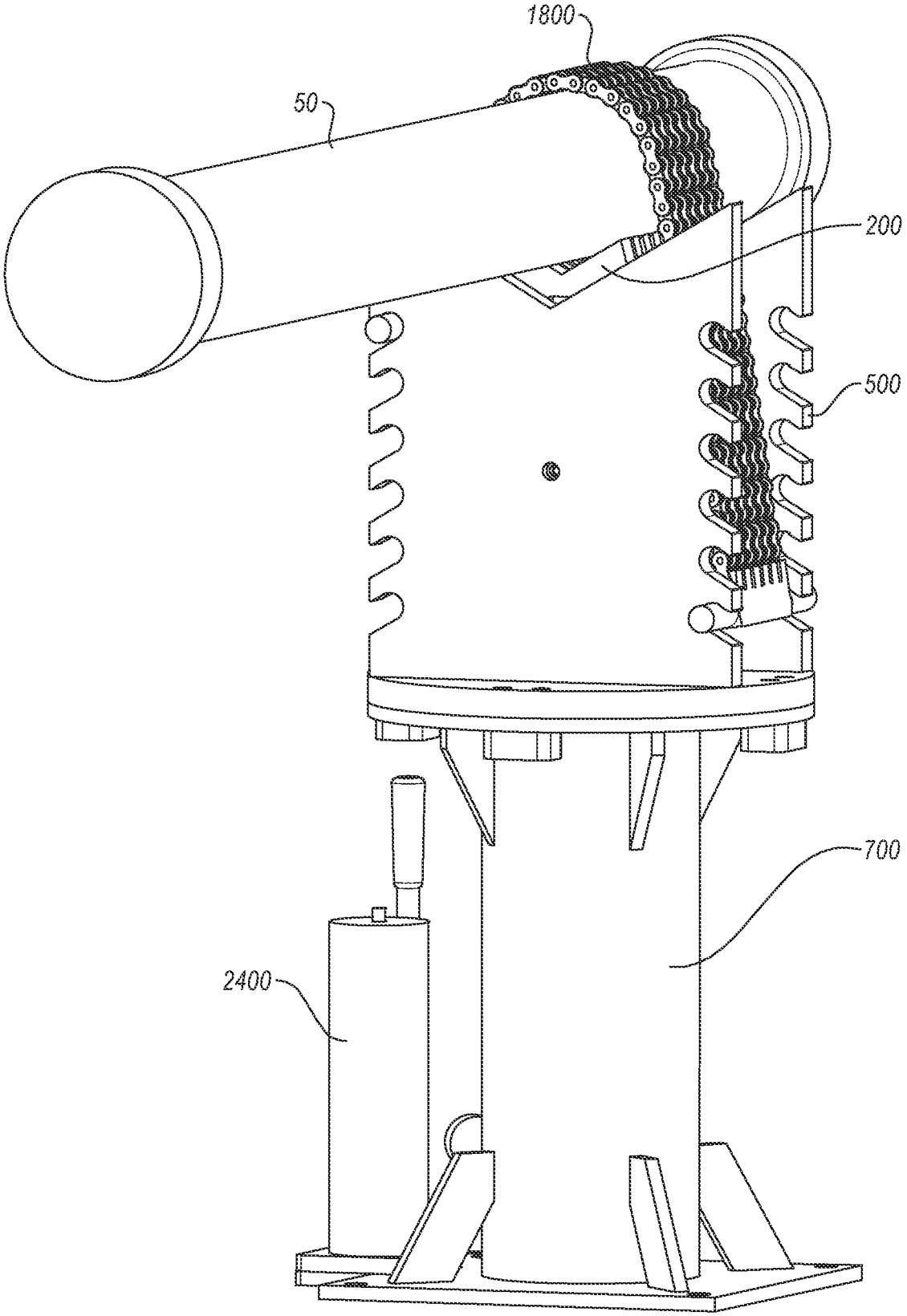
FIG. 1D is an image depicting another view of the cylinder vice of FIG. 1A.

FIGS. 1A-1D illustrate an example cylinder vice 100, arranged in accordance with at least one embodiment described in the present disclosure. FIG. 1A depicts a schematic diagram of an end view of the cylinder vice 100. FIG. 1B depicts a schematic diagram of a side view of the cylinder vice 100. FIG. 1C is an image of a perspective view of the cylinder vice 100. FIG. 1D is an image of another perspective view of the cylinder vice 100.

The cylinder vice 100 is configured to retain a cylindrical structure or a cylindrical portion of a structure. For example, with reference to FIG. 1D, the cylinder vice 100 may be configured to retain an example cylindrical structure 50. The cylinder vice 100 may retain the cylindrical structure 50 during maintenance or reconstruction of a hydraulic device that includes cylindrical structure 50. For instance, an example use of the cylinder vice 100 may include a maintenance of a hydraulic device that includes the cylindrical structure 50. During the maintenance, the cylindrical structure 50 may be held substantially still while work is performed on the hydraulic device.

With continued reference to FIG. 1D, the cylinder vice 100 is configured to retain cylindrical structure 50 through provision of a force to the cylindrical structure 50. The force displaces the cylindrical structure 50 relative to a vice assembly 500 of the cylinder vice 100 and against a chain assembly 1800.

For instance, in the embodiment of FIG. 1D, the cylinder vice 100 may include a jaw assembly 200 that is pressed in substantially the y-direction of an arbitrarily defined coordinate system of FIGS. 1A-1D. The jaw assembly 200 may be pressed against an underside of the cylindrical structure 50. The jaw assembly 200 forces the cylindrical structure 50 against the chain assembly 1800, or central portion thereof that is positioned on another surface of the cylindrical structure 50, which may be substantially opposite the underside of the cylindrical structure 50. The chain assembly 1800 is secured at each end to a vice assembly 500. For instance, the chain assembly 1800 may include retainers that are configured to be positioned in notches defined in the vice assembly 500. The chain assembly 1800 conforms to the outer surface of the cylindrical structure 50. The jaw assembly 200 moves relative to the vice assembly 500, which enables the jaw assembly 200 to press the cylindrical structure 50 into the chain assembly 1800. When the jaw assembly 200 has pressed the cylindrical structure 50 against the chain assembly 1800, the cylindrical structure 50 may be retained in a fixed or substantially fixed position relative to the cylinder vice 100.

In the embodiment of FIG. 1D, the cylinder vice 100 may include a hydraulic assembly 2400. The hydraulic assembly may be configured to provide a hydraulic pressure and/or a pneumatic pressure against jaw assembly 200, which may result in the translation of the jaw assembly 200 relative to the vice assembly 500.

Referring to FIGS. 1A-1D, the cylinder vice 100 may include the jaw assembly 200, the vice assembly 500, and a base assembly 700. The base assembly 700 supports the vice assembly 500 above a surface such as the floor of a shop. The base assembly 700 is configured to be secured to the ground (e.g., a floor of a shop or another suitable surface) and rotationally secure to the vice assembly 500. For example, at a first end the base assembly 700 is fixed to the ground 105 (FIGS. 1A and 1B only). At a second end the base assembly 700 is rotationally fixed to the vice assembly 500. For instance, at least a portion of the base assembly 700 is totally fixed to the ground 105 and the vice assembly 500 may rotate relative to the portion of the base assembly 700 fixed to the ground 105. In FIGS. 1A and 1B, the rotational coupling between the base assembly 700 and the vice assembly 500 is labelled 107.

The rotational coupling 107 enables the vice assembly 500 to be fixed at a selected angle relative to the base assembly 700. For instance, the vice assembly 500 may be rotated to a first particular angle and then fixed relative to the base assembly 700. Subsequently, the vice assembly 500 may be rotated to a second particular angle and then fixed relative to the base assembly 700. In some embodiments, the rotational coupling 107 prohibits translation in any direction other than rotation about an axis that is substantially parallel to the y-axis. Rotation of the vice assembly 500 relative to the base assembly 700 may enable a positioning of a cylindrical structure relative to an environment.

In the embodiment of FIGS. 1A-1D, the jaw assembly 200 is not fixed relative to the vice assembly 500 or the base assembly 700. Instead, the jaw assembly 200 is configured to be positioned within a portion of the vice assembly 500. The jaw assembly 200 is guided within the vice assembly 500 and translates relative to the vice assembly 500. For instance, in FIGS. 1A and 1B, the jaw assembly 200 is depicted exploded in the y-direction from the vice assembly 500. In FIG. 1C, the jaw assembly 200 is depicted removed from the vice assembly 500 and placed on the ground 105 next to the cylinder vice 100. In FIG. 1D, the jaw assembly 200 is depicted positioned in the vice assembly 500.

In some embodiments, one or more of the base assembly 700, the vice assembly 500, the jaw assembly 200, the chain assembly 1800, and the hydraulic assembly 2400 may be omitted. For instance, in some embodiments, the base assembly 700 may be omitted. In these and other embodiments, the vice assembly 500 may be secured directly to the ground 105, to a table, to a vehicle or another suitable surface. Additionally, the hydraulic assembly 2400 may be omitted. In these and other embodiments, the jaw assembly 200 may be translated or displaced by another mechanism such as an electro-mechanical actuator, a screw-type actuator, or another suitable device. Moreover, in the depicted embodiment, the jaw assembly 200 is translated in a vertical direction relative to the chain assembly 1800. In other embodiments, the jaw assembly 200 may move in another direction (e.g., horizontally or at some angle).

Some additional details of each of the base assembly 700, the vice assembly 500, the jaw assembly 200, the chain assembly 1800, and the hydraulic assembly 2400 are provided below.

Figure 2:
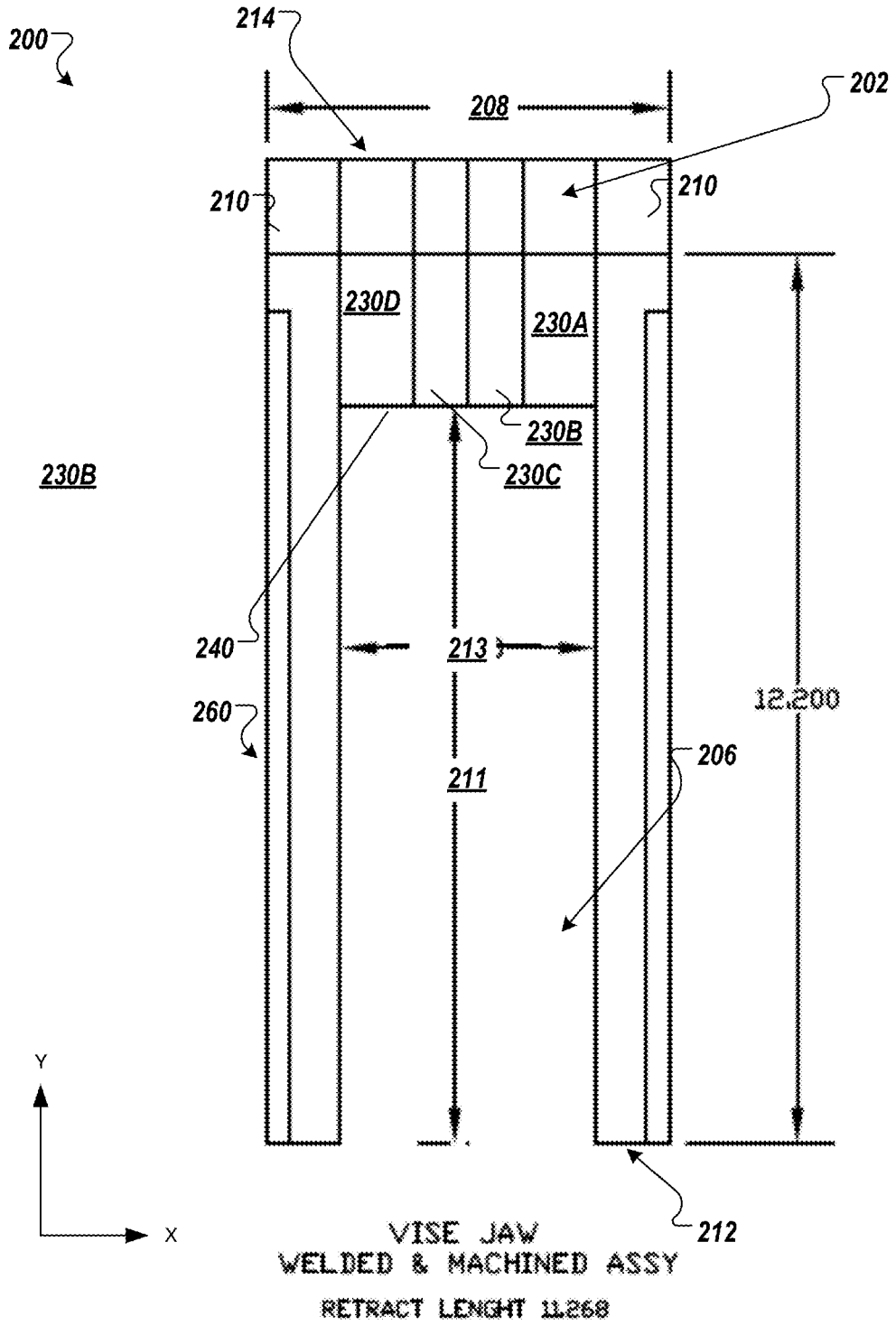
FIG. 2 illustrates an example jaw assembly that may be implemented in the cylinder vice of FIGS. 1A-1D.

FIG. 2 illustrates an example embodiment of the jaw assembly 200 that may be implemented in the cylinder vice 100 of FIGS. 1A-1D. FIG. 2 is a sectional view of the jaw assembly 200. The jaw assembly 200 includes a central structure 202 and an outer structure 204. Together the central structure 202 and the outer structure 204 may devise a cavity 206 into which a portion of a hydraulic assembly (e.g., the hydraulic assembly 2400) may be positioned. For example, a hydraulic actuator may be placed in the cavity 206 such that a translational surface of the hydraulic actuator contacts and acts on a jaw bottom surface 240. In embodiments in which another type of actuator is used to move the jaw assembly 200, the other type of actuator may be positioned in the cavity 206.

The cavity 206 may include the volume between outer plates 210A and 210B (generally outer plate 210 or outer plates 210) that make up the outer structure 204. The cavity 206 may further include the volume between an end 212 of the outer plates 210. In some embodiments, the cavity 206 may include a width 213 (in the x-direction) of about 3.5 inches and a height 211 (in the y-direction) of about 10.125 inches. The width 213 and height 211 may be configured to receive an actuator that has a stroke of about four to about six inches. In other embodiments, the width 213 and the height 211 may be more than or less than the provided values. For instance, the cavity 206 may be configured to receive a particular the actuator or a particular actuator with a particular stroke.

The jaw assembly 200 may include an outer dimension 208 that may be defined from a first outer plate 210A to a second outer plate 210B. The outer dimension 208 may be configured to fit within a vice assembly such as the vice assembly 500 of FIGS. 1A-1D. In the depicted embodiment, the outer dimension may be between about 5.5 and about 6.5 inches. For instance, the central structure may be about 4 inches in width and the outer plates 210 may be about one inch thick.

Additionally, in the depicted embodiment the central structure 202 may be comprised of multiple inner plates 230A-230D (generally, inner plate 230 or inner plates 230). One of the inner plates 230 may be positioned adjacent to each of the outer plates 210. Additionally, the inner plates 230 may be positioned next to at least one other of the inner plates 230. For example, at least one surface of each of the inner plates 230 may contact at least one surface of another of the inner plates 230. The inner plates 230 may be welded to one another and/or to the outer plates 210.

In the embodiment of FIG. 2, the jaw assembly 200 includes four inner plates 230. In other embodiments, the jaw assembly 200 may include fewer than four or more than four inner plates 230. Additionally or alternatively, in some embodiments, the outer plates 210 may be formed in a singular structure with the inner plates 230.

In some embodiments, the outer plates 210 and the inner plates 230 each have a top surface 214. The top surface 214 may include a V-shape geometry. The V-shape geometry of the inner plates 230 and the V-shape geometry of the outer plates 210 may be substantially the same. An angle of the V-shape geometry may be obtuse (as better shown in FIGS. 3A and 4A below). For instance, the V-shape geometry in the embodiment of FIG. 2 may include an angle between about 90 and about 140 degrees, and may include an angle of about 120 degrees.

In some embodiments, the V-shape geometry of the outer plates 210 and the inner plates 230 may be designed for cylindrical structures (e.g., 50 of FIG. 1D) having a particular diameter range. For instance, the V-shape geometry may include a larger obtuse angle (e.g., greater than 90 degrees but less than 180 degrees) for larger cylindrical structures. For smaller diameter cylindrical structures, the angle may be smaller than 120 degrees or the angle may include an acute angle.

Additionally or alternately, the angle of the V-shape geometry of the outer plates 210 and the inner plates 230 may relate to an amount of surface area in contact with a chain assembly (e.g., 1800 of FIG. 1D). For instance, as the angle becomes more acute, the higher the cylindrical structure will sit in the "V," and the more surface area of the cylindrical structure will contact with the chain assembly.

Figure 3A:
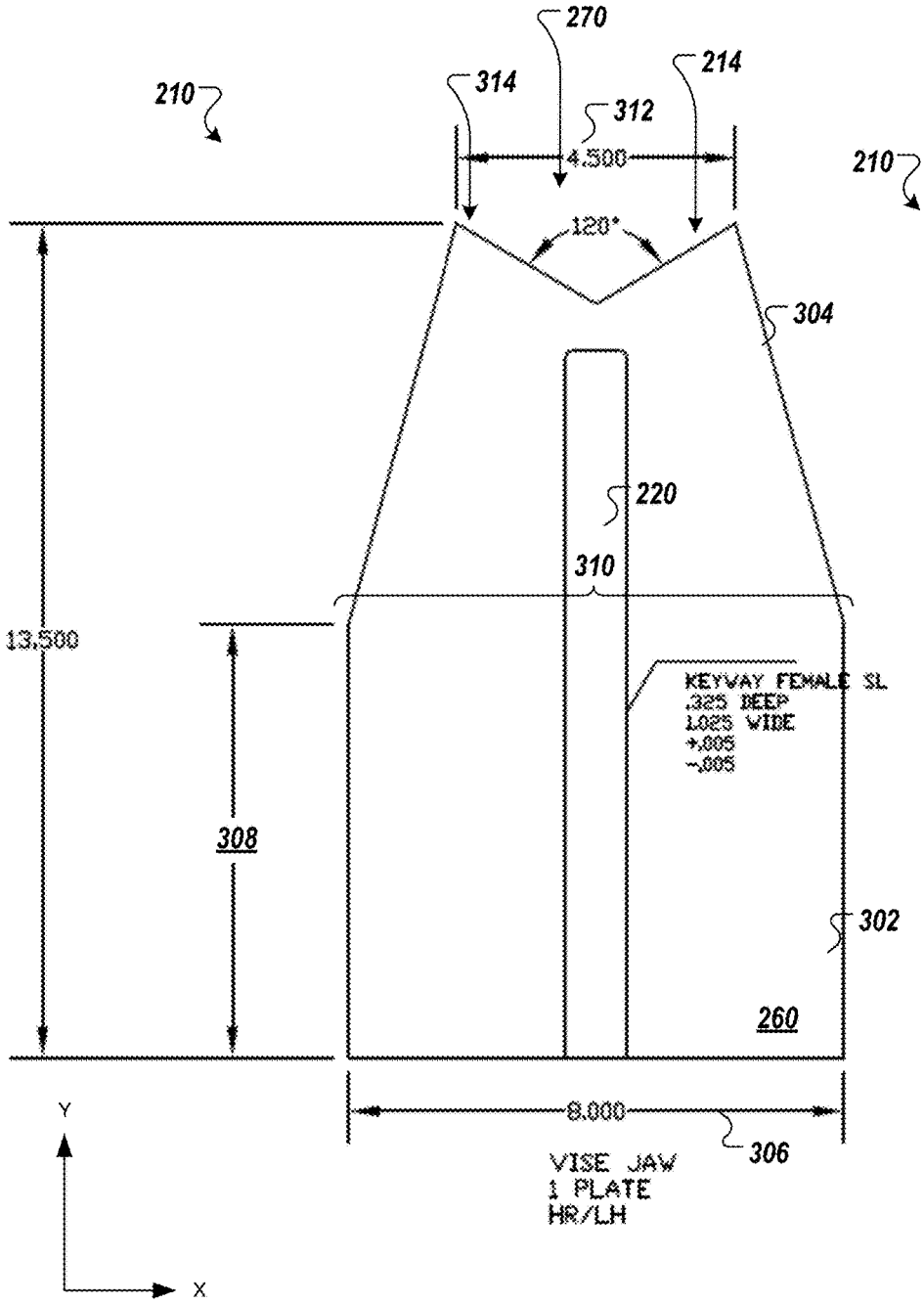
FIG. 3A illustrates an example outer plate that may be implemented in the jaw assembly of FIG. 2.
Figure 3B:
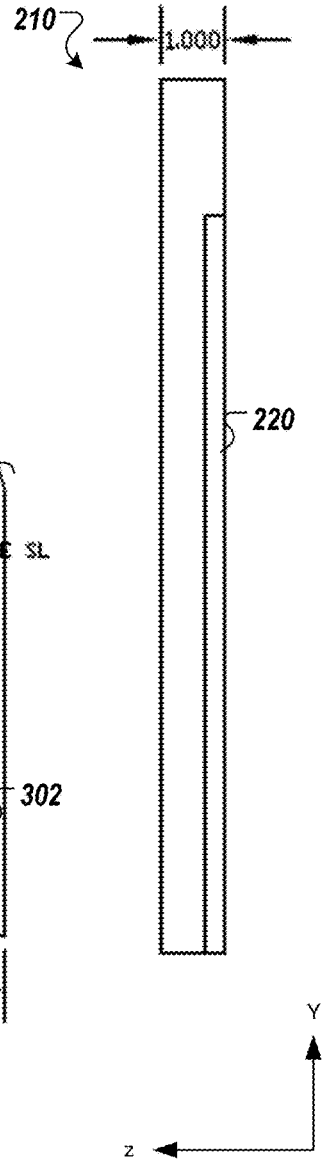
FIG. 3B is another view of the outer plate of FIG. 3A.

FIGS. 3A and 3B illustrate an example embodiment of the outer plate 210. The outer plate 210 of FIGS. 3A and 3B may be implemented in the jaw assembly 200 of FIG. 2. FIG. 3A depicts a front view of the outer plate 210. FIG. 3B depicts a side sectional view of the outer plate 210.

The outer plate 210 may include a jaw external face 260. With combined reference to FIGS. 3A and 2, the jaw external face 260 is oriented away from the inner plates 230. When the jaw assembly 200 is positioned in the vice assembly (e.g., 500 of FIGS. 1A-1D), the jaw external face 260 is oriented outward, towards portions of the vice assembly. The jaw assembly 200 may include two outer plates 210, which may be substantially similar. Alternatively, the jaw assembly 200 may include one outer plate 210 as depicted in FIGS. 3A and 3B and another outer plate with different features.

Referring back to FIGS. 3A and 3B, the outer plate 210 may include a rectangular portion 302 that adjoins an angled portion 304. The angled portion 304 may be at an upper (e.g., having a higher y-coordinate) portion of the rectangular portion 302. The rectangular portion 302 may include a width 306 that is about 85% of a height 308. The angled portion 304 may have a lower width 310 that is substantially the same as the width 306. The angled portion 304 may also include an upper width 312 that is smaller than the lower width 310. The upper width 312 may be about 55% of the lower width 310. In the embodiment of FIGS. 3A and 3B, the rectangular portion 302 may include a width 306 of about 8 inches and a height 308 of about 7 inches. The angled portion 304 may have a lower width 310 of about 8 inches and an upper width 312 of about 4.5 inches. In other embodiments, the outer plate 210 may be larger or smaller and may take the shape that is similar to that depicted in FIGS. 3A and 3B.

The jaw external face 260 may define a female slide 220. The female slide 220 may include a substantially rectilinear volume defined in the jaw external face 260. In the embodiment of FIGS. 3A and 3B, the female slide 220 includes a depth that is a portion of the width of the outer plate 210 and is substantially centered in an x-direction on the jaw external face 260. The female slide 220 may be located in a central portion of the jaw external face 260.

In other embodiments, the female slide 220 may be located off center on the jaw external face 260. Additionally, the female slide 220 may be defined through an entire thickness of the outer plate 210. Also, in some embodiments, the outer plate 210 may include two or more female slides 220.

In the embodiment of FIGS. 3A and 3B, the female slide 220 may include a width of about 1.025 inches and a depth (in the z-direction) of about 0.325 inches. In other embodiments, the width and the depth of the female slide 220 may be greater than or less than these dimensions. For instance, in embodiments of the outer plate 210 with a greater depth, the depth of the female slide 220 may be greater (e.g., maintain a ratio of about 1 to 3).

The female slide 220 may be configured to laterally fix the jaw assembly with respect to the vice assembly (e.g., 500 of FIGS. 1A-1D). For example, the female slide 220 may be configured to physically correspond to a male slide. The male slide may have a similar or substantially similar shape such that the male slide may be received in the female slide 220. When received in the female slide 220, the male slide may limit or prohibit motion in the x-direction while enabling motion in the y-direction. Some additional details of the female slide 220 are provided below.

The outer plate 210 may define a V-shape geometry 314. The V-shape geometry 314 is described above. When the outer plate 210 supports a cylindrical structure (e.g., 50 of FIG. 1D), an outer surface of the cylindrical structure may contact the top surface 214. For instance, as the outer plate 210 is translated towards the chain assembly, the top surface 214 physically and directly contacts the outer surface and presses on the outer surface of the cylindrical surface.

Figure 4B:
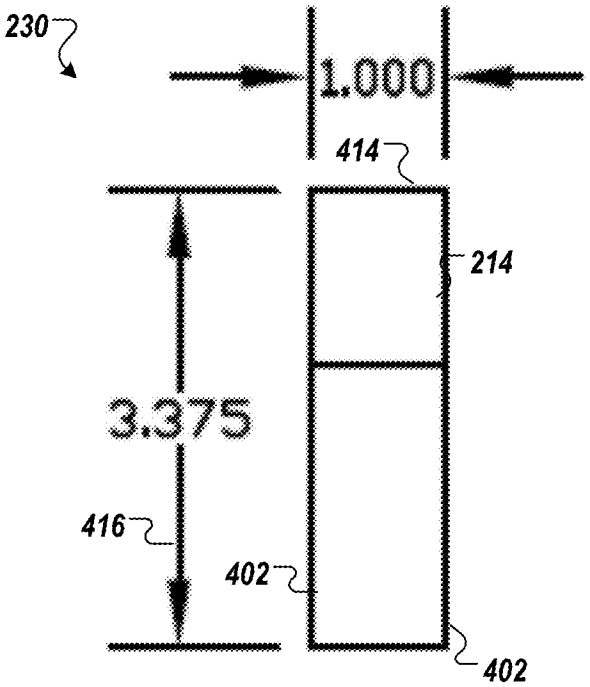
FIG. 4B is another view of the inner plate of FIG. 4A.
Figure 4A:
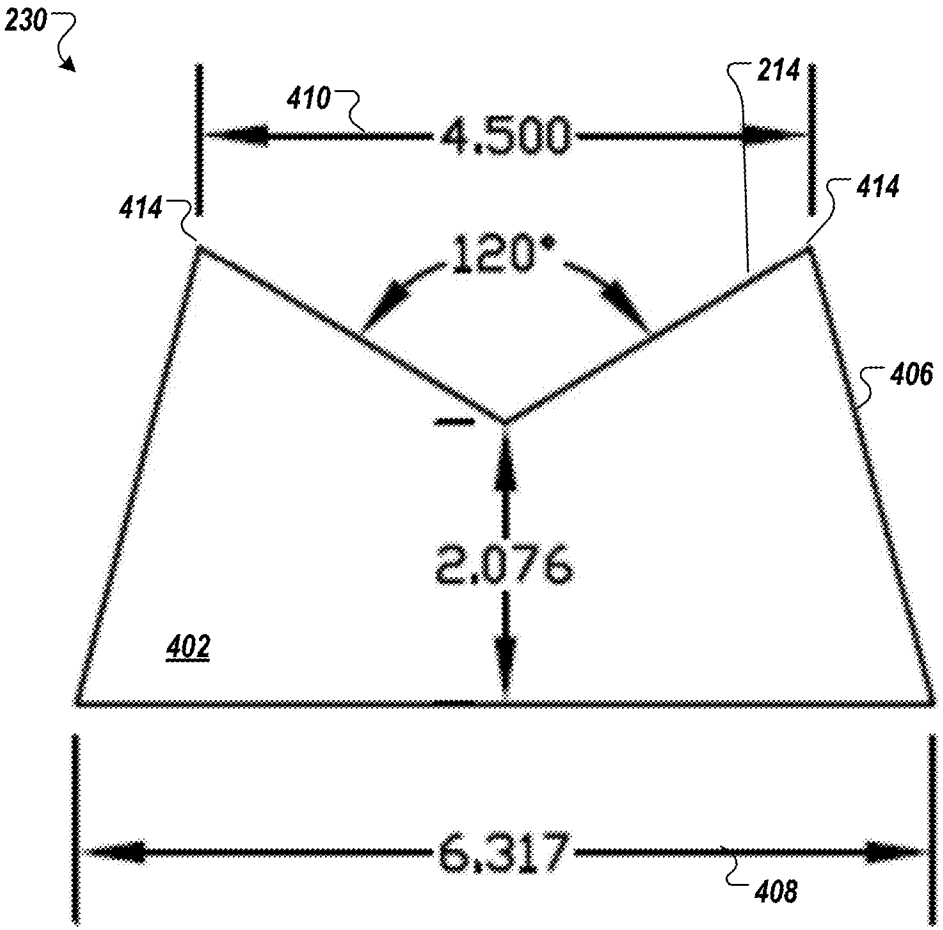
FIG. 4A illustrates an example inner plate that may be implemented in the jaw assembly of FIG. 2.

FIGS. 4A-4B illustrate an example embodiments of the inner plate 230 that may be implemented in the jaw assembly 200 of FIG. 2. The inner plate 230 of FIGS. 4A and 4B may be implemented in the jaw assembly 200 of FIG. 2. FIG. 4A depicts a front view of the inner plate 230. FIG. 4B depicts a side sectional view of the inner plate 230.

The inner plate 230 may include two plate faces 402. With combined reference to FIGS. 4A and 2, when the jaw assembly 200 is assembled, the plate faces 402 may be oriented towards a plate face 402 of another inner plate 230 or a face (e.g., jaw external face 260) of an outer plate 210. The jaw assembly 200 may include four inner plates 230, which may be substantially similar. Alternatively, the jaw assembly 200 may include one or more inner plates 230 as depicted in FIGS. 4A and 4B and another inner plate with one or more different features.

Referring back to FIGS. 4A and 4B, the inner plate 230 may include an angled structure 406 with the V-shape geometry defined at an upper end. The angled structure 406 may coincide with an upper portion of the angled portion 304 of the outer plate 210. The angled structure 406 may include a lower width 408 and an upper width 410. The upper width 410 may be about 72% of the lower width 408. The upper width 410 may be defined between two upper edges 414 of the V-shape geometry. The V-shape geometry may extend in a negative y-direction from the upper edges 414. For instance, the V-shape geometry may extend about 38% of a height 416. In the depicted embodiment, the upper width 410 is about 4.5 inches, the lower width 408 is about 6.316 inches, and the height 416 may be about 3.375 inches. In other embodiments, the upper width 410, the lower width 408, the height 416 may be another suitable width. In these and other embodiments, one or more of the ratios described above may be maintained.

Figure 5A:
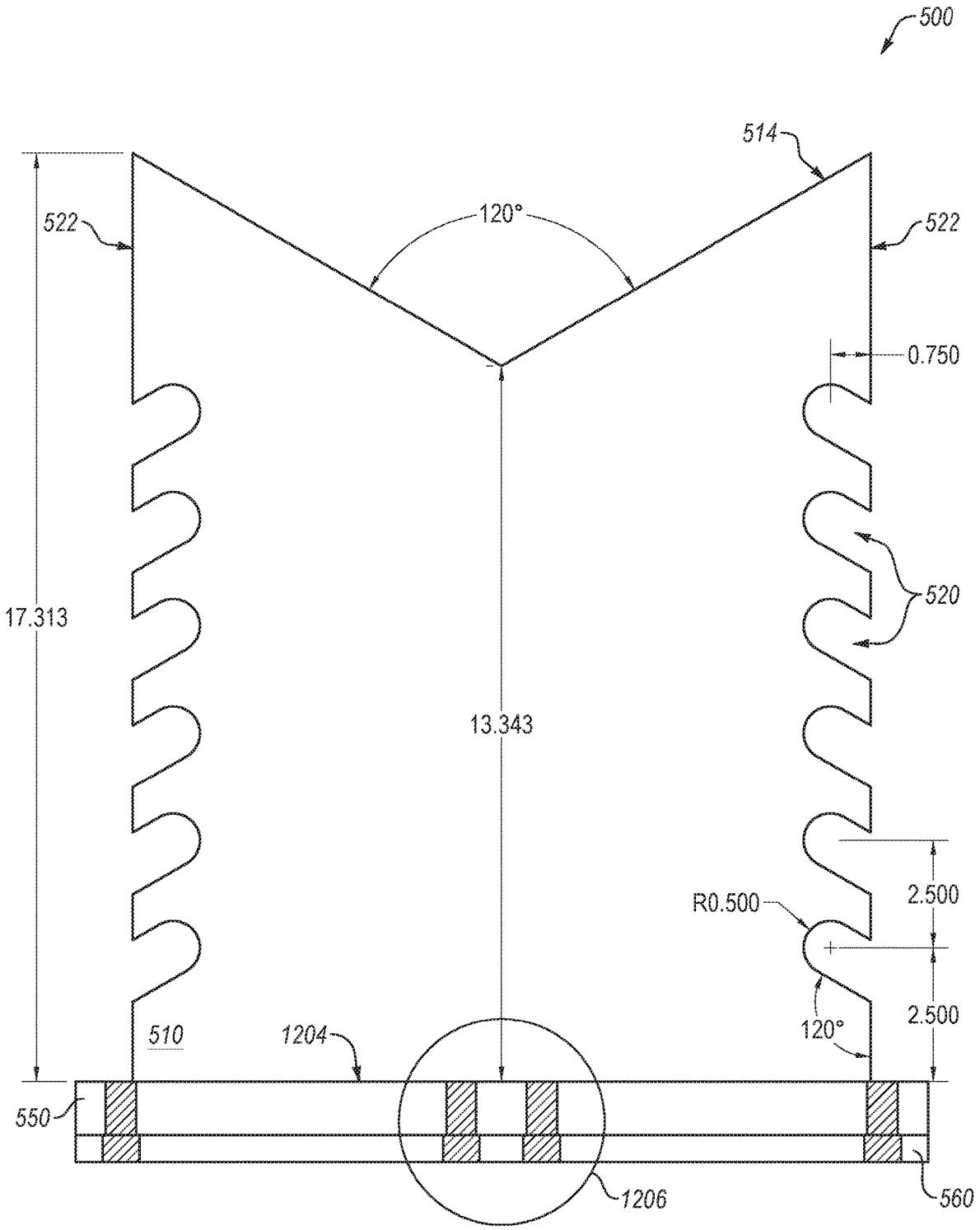
FIG. 5A illustrates an example vice assembly that may be implemented in the cylinder vice of FIGS. 1A-1D.
Figure 5B:
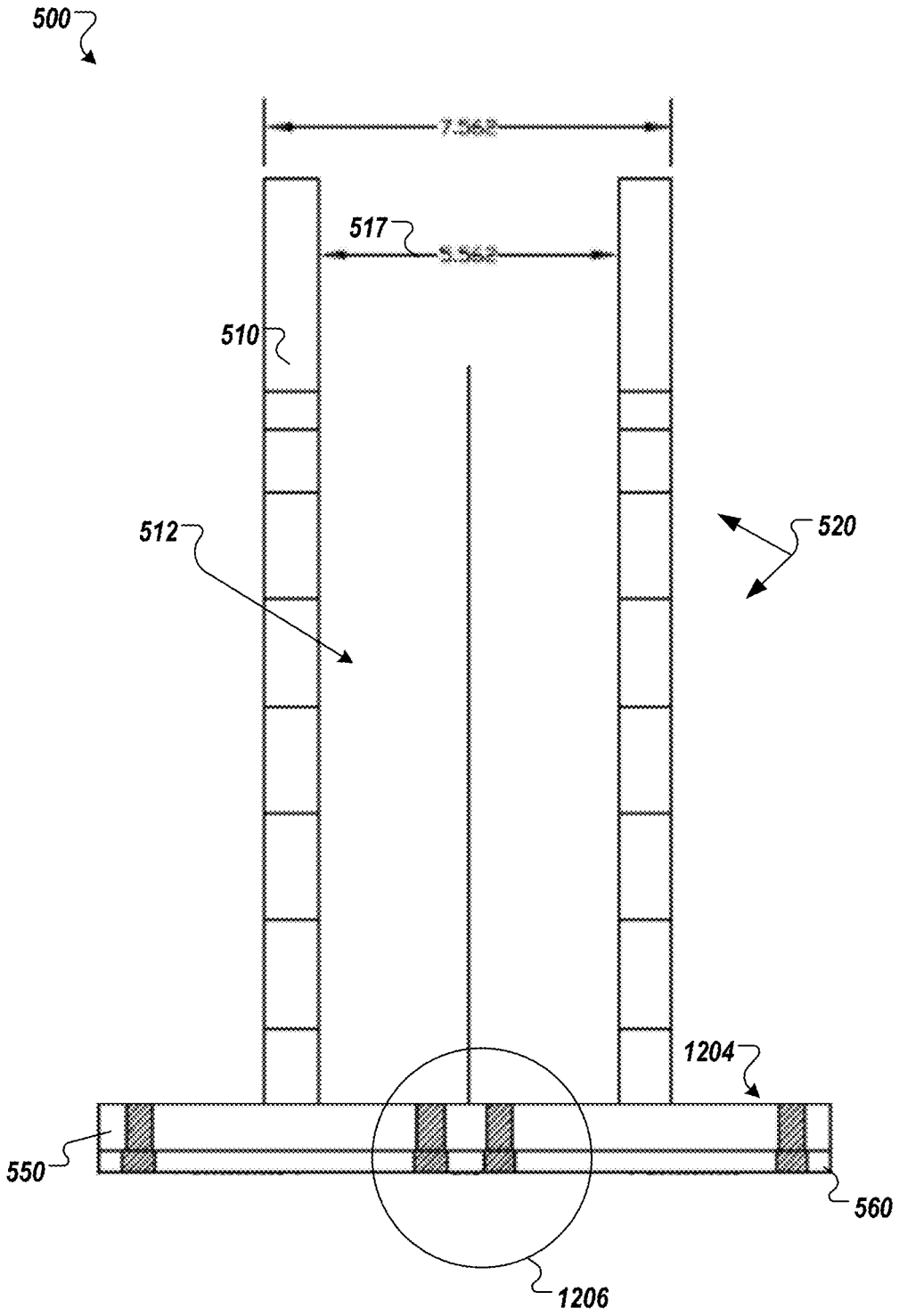
FIG. 5B is another view of the vice assembly of FIG. 5A.

FIGS. 5A-5B illustrate an example embodiment of the vice assembly 500 that may be implemented in the cylinder vice 100 of FIGS. 1A-1D. FIG. 5A depicts a front view of the vice assembly 500. FIG. 5B depicts a side view of the vice assembly 500.

The vice assembly 500 may include two side braces 510. The side braces 510 may define a volume 512 into which a jaw assembly such as the jaw assembly 200 described herein may be received. For example, the side braces 510 may be separated by separation width 517. The separation width 517 may be substantially equal to an outer dimension (e.g., 208 of FIG. 2) of the jaw assembly.

The side braces 510 may be substantially rectangular with a triangular portion removed therefrom. An upper surface 514 may be configured to support a cylindrical structure when the cylindrical vice is not actuated. The vice assembly 500 may include one or more angled surfaces that may press against an outer surface of a cylindrical structure retained in the vice assembly 500. The angled surfaces may reduce movement of the cylindrical structure relative to the cylinder vice 100. For example, in other vices, a flat or substantially flat surface may act to retain the cylindrical structure in a vice. The flat or substantially flat surface may enable a rotation of the cylindrical structure, which may result in translation of the cylindrical structure relative to the vice.

The side braces 510 may define one or more notches 520, only a subset of which are labelled in FIGS. 5A and 5B. The notches 520 may be defined along each of two edges 522 of the side braces 510. In the depicted embodiment, the notches 520 may be angled in a negative y-direction and have a circular portion. In the depicted embodiment, the angle may be about 120 degrees.

For example, the notches 520 may be spaced along the edges 522 at increments of about one inch to about three inches. In other embodiments, increments of less than one inch or more than three inches. Additionally or alternately, the notches 520 may have a radius of about ⅛ inch to about 1 inch. In other embodiments, a radius less than ⅛ inch or more than 1 inch. Additionally or alternately, the notches 520 may have a radius that is positioned about ¼ inch to about 2 inches from the edges 522. In the embodiment of FIGS. 5A and 5B there are six notches 520 defined along each edge 522. In other embodiments, there may be fewer than six or more than six notches 520 defined along one or more of the edges 522. Additionally, one or more of the notches 520 may have different shapes or may be oriented at a different angle (e.g., more than 120 or less than 120 degrees). The notches 520 may be configured to retain portions of a chain assembly (e.g., the chain assembly 1800).

In these and other embodiments, the V-shape geometry of the top edge may function to prevent the cylindrical structure from rolling off the cylinder vice 100 when the cylindrical structure is not being worked. The V-shape geometry of the side braces 510 may be designed for various diameter sizes for different cylindrical structures. Similar to the V-shape geometry of the jaw assembly, the V-shape geometry may be an upright "V" having an obtuse angle. For smaller diameter cylindrical structures, the angle may be smaller than 120 degrees but still obtuse (greater than 90 degrees), or the angle may be smaller than 90 degrees (an acute angle).

In some embodiments, the side braces 510 may be designed to hold the cylindrical structure when it is not being worked. With combined reference to FIGS. 1A, 1D, 2A, and 5B, in some embodiments, the jaw assembly 200 may be positioned between the side braces 510. The jaw assembly 200 may be configured to actuate or translate in an upward direction. For instance, prior to actuation, the jaw assembly 200 or the top surface 214 of the jaw assembly 200 may be below the upper surface 514 of the vice assembly 500. The cylindrical structure 50 may then rest on the upper surface 514 of the vice assembly 500. As the jaw assembly 200 is translated upwards, a portion of the jaw assembly 200 may extend above the upper surface 514. The cylindrical structure 50 may then be held by the top surface 214 instead of the upper surface 514. The notches 520 may be angled in a downward fashion such that when the jaw assembly 200 actuates upwards, a chain retainer does not slip out of the notches 520.

In the vice assembly 500 of FIGS. 5A and 5B, the side braces 510 may be welded or otherwise attached to a vice base plate 550. The vice base plate 550 may be further welded or otherwise attached to a retainer ring 560. The vice base plate 550 and the retainer ring 560 are configured to be placed on and rotationally attached to a base assembly such as the base assembly 700 described elsewhere in the present disclosure. An example of the vice base plate 550 and the retainer ring 560 are depicted in FIGS. 12 and 14, respectively.

Figure 12:
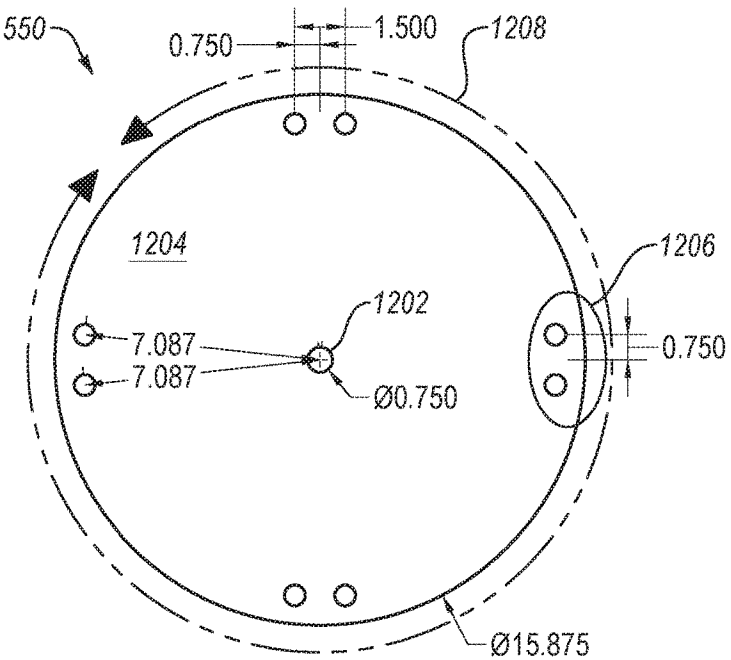
FIG. 12 illustrates an example vice base plate that may be implemented in the vice assembly of FIGS. 5A-5B.

With reference to FIG. 12, the vice base plate 550 includes a disk of material with multiple holes defined therein. For instance, the vice base plate 550 may include a center point at which there is a thru hole 1202 as defined. The thru hole 1202 may align or substantially align with the central axis of a base assembly (e.g., 700) or components thereof. Additionally, the thru hole 1202 may be used as an attachment point for an actuator positioned on an upper surface 1204 of the vice base plate 550.

Figure 14:
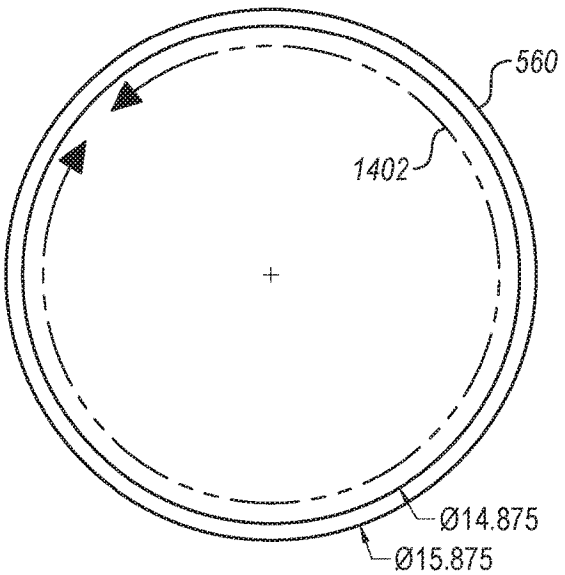
FIG. 14 illustrates an example retainer ring that may be implemented in the vice assembly of FIGS. 5A-5B.

With reference to FIGS. 12 and 14, the vice base plate 550 may include a plate circumference 1208. The retainer ring 560 may include a ring of material. The plate circumference 1208 may correspond to a ring circumference 1402 of the retainer ring 560. Because the correspondence between the ring circumference 1402 of the retainer ring 560 and the plate circumference 1208 of the vice base plate 550, the retainer ring 560 may be attached along the plate circumference 1208. Attachment between the vice base plate 550 and the retainer ring 560 results in the retainer ring 560 extending from the vice base plate 550 around the plate circumference 1208. In the depicted embodiment, the plate circumference 1208 and the ring circumference 1402 are about 49.87 ($\pi$*15.875) inches. In other embodiments, the plate circumference 1208 and the ring circumference 1402 may be greater than or less than 49.87 inches. Additionally or alternatively, the plate circumference 1208 may include a dimension that is different from the ring circumference 1402. In these and other embodiments, the retainer ring 560 may not be at the outer edge of the vice base plate 550.

The vice base plate 550 may also define one or more sets of perimeter holes 1206. The perimeter holes 1206 may be positioned between the plate circumference 1208 and the thru hole 1202. A distance from the plate circumference 1208 may be sufficient to allow the retainer ring 560 to be attached to the vice base plate 550. The perimeter holes 1206 may be configured to rotationally secure the vice assembly 500 to a base assembly (e.g., 700) or to anther suitable structure.

Figure 6C:
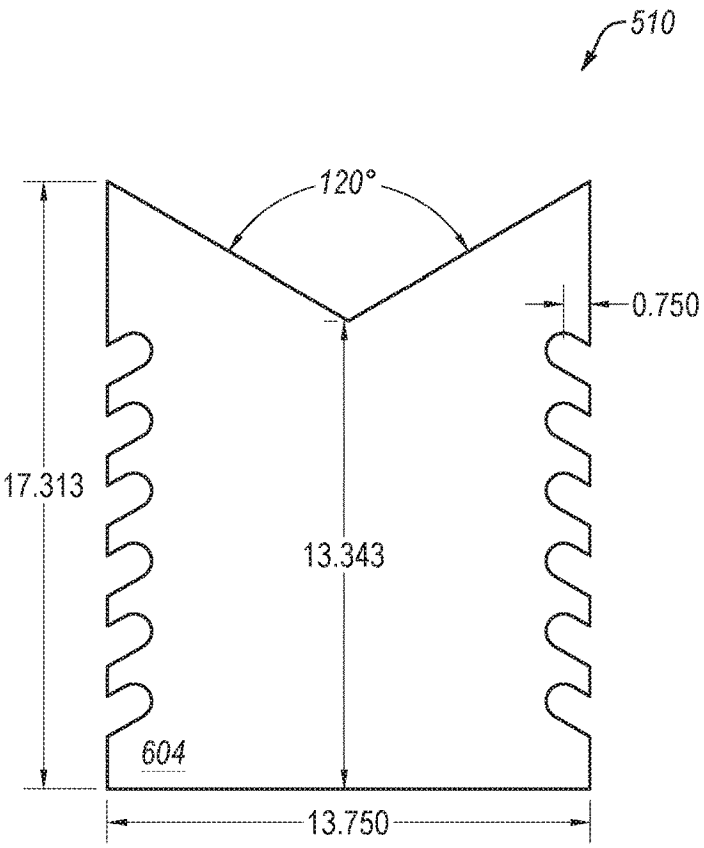
FIG. 6C is another view of the side brace of FIG. 6A.
Figure 6B:
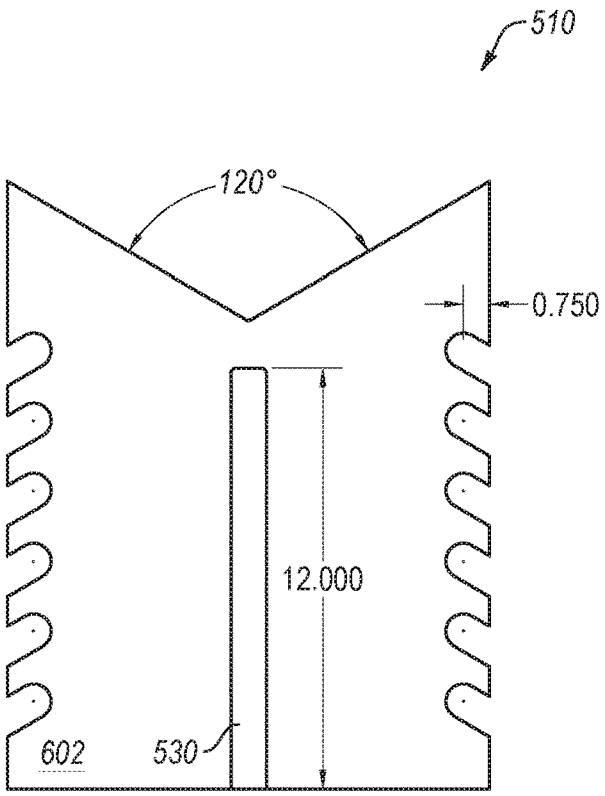
FIG. 6B is another view of the side brace of FIG. 6A.
Figure 6A:
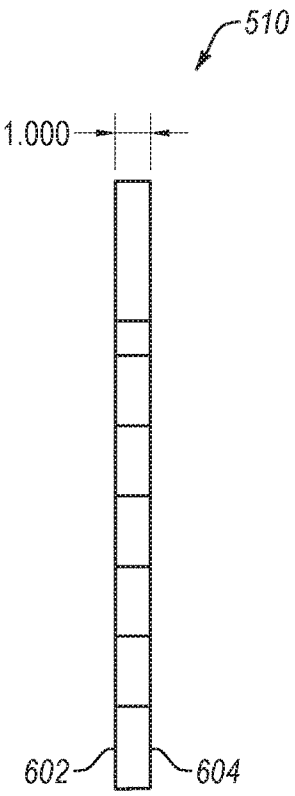
FIG. 6A illustrates an example side brace that may be implemented in the vice assembly of FIGS. 5A-5B.

FIGS. 6A-6C illustrate an example embodiment of the side brace 510 that may be implemented in the vice assembly 500 of FIGS. 5A-5B. FIG. 6A depicts a side view of the side brace 510. FIG. 6B depicts a view of an inner surface 602. FIG. 6C depicts a view of an outer surface 604. The vice assembly 500 may include two of the side braces 510 or may include one of the side braces 510 and one side brace with different features.

In some embodiments, the side braces 510 may include a male slide 530. The male slide 530 may be positioned on a central portion of the inner surface 602. The male slide 530 may protrude outwardly from the inner surface 602 into the volume 512 described above. The male slide 530 is configured to guide a jaw assembly such as the jaw assembly 200 as it translates in the y-direction and the negative y-direction relative to the vice assembly. For instance, the male slide 530 may result in a smooth, consistent translation in which the jaw assembly 200 movement is substantially limited to the y-direction. The male slide 530 may also allow for easy assembly/disassembly of the jaw assembly 200. For example, unless the male slide 530 interfaces with a corresponding female slide of the jaw assembly 200, then the jaw assembly 200 may not fit between the side braces 510.

With combined reference to FIGS. 3A and 6B, the female slide 220 may correspond to the male slide 530. In these or other embodiments, the female slide 220 may permit the male slide 530 to guide the jaw assembly 200 as a piston or another device translates the jaw assembly 200 in an upward direction. Additionally or alternately, the female slide 220 may guide the jaw assembly 200 as it returns to a rest position. The female slide 220 may reduce or prevent the jaw assembly 200 from becoming off-kilter, off-axis, or otherwise translating in a direction other than the y-direction.

Figure 7:
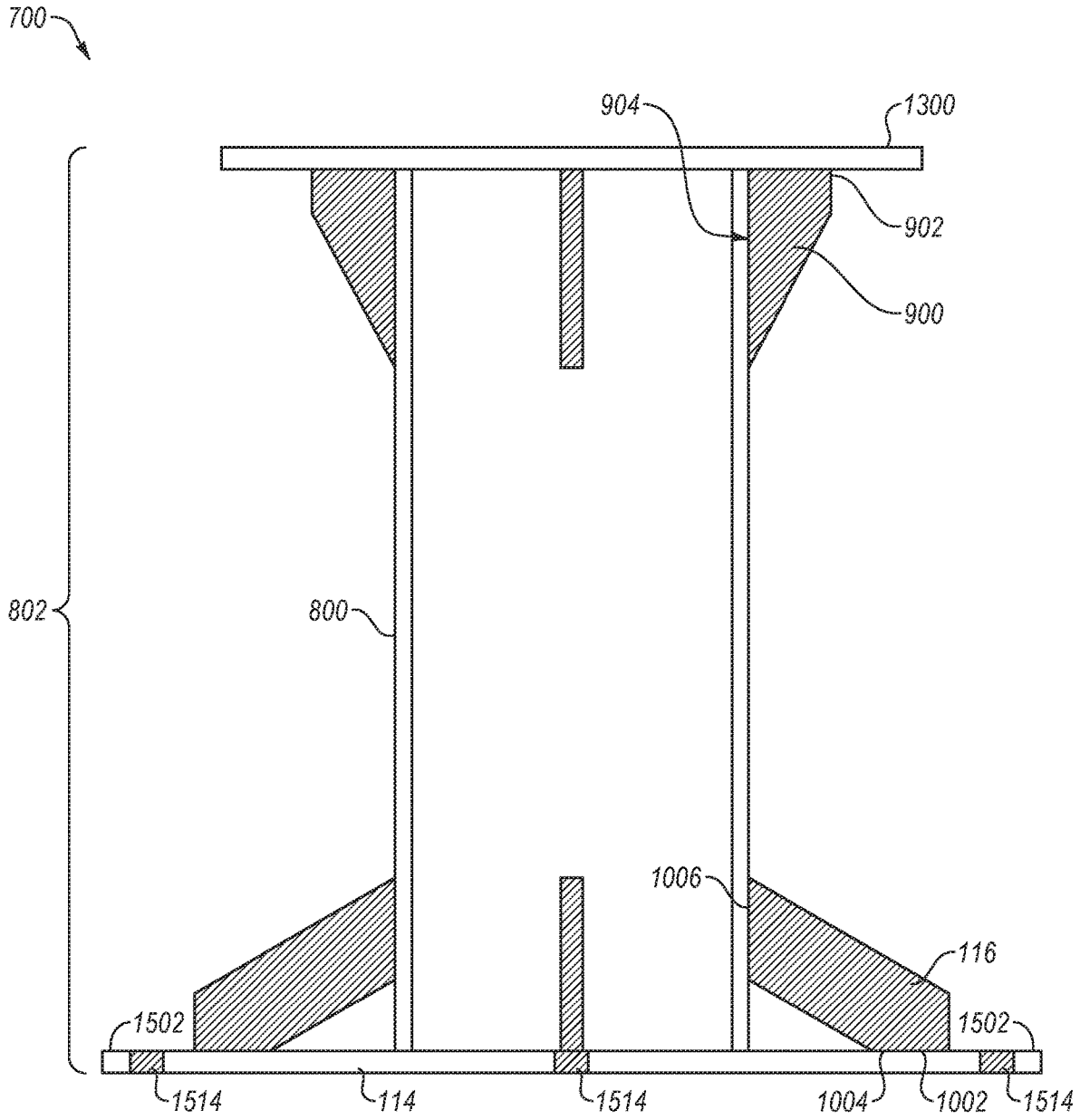
FIG. 7 illustrates an example base assembly that may be implemented in the cylinder vice of FIGS. 1A-1D.

FIG. 7 illustrates an example embodiment of the base assembly 700 that may be implemented in the cylinder vice 100 of FIGS. 1A-1D. FIG. 7 depicts a side view of the base assembly 700. The base assembly 700 may be configured to retain a vice assembly such as the vice assembly 500 above a surface such as the floor of a shop or another suitable location.

The base assembly 700 may include a tower 800 that is welded or otherwise attached to a tower base plate 114 and a tower top plate 1300. The tower 800 may have an outer diameter, a wall thickness, and a height that is sufficient to withstand applied forces, provide stability and/or rigidity, and withstand general wear and tear and/or accidental abuse. In the depicted embodiment, for example, the tower 800 includes an outer diameter between about 4 inches to about 12 inches, a wall thickness between about ⅛ inch to about 1 inch, and a height between about 2 feet to about 4 feet. In other embodiments, the outer diameter, the wall thickness, and the height may vary based on ergonomic considerations or requirements for individuals working on the cylindrical structure.

The base assembly 700 may include one or more tower base plate gussets 116 welded or otherwise attached between the tower 800 and the tower base plate 114. The base assembly 700 may include one or more tower top plate gussets 900 welded or otherwise attached between the tower 800 and the tower top plate 1300.

Figure 8:
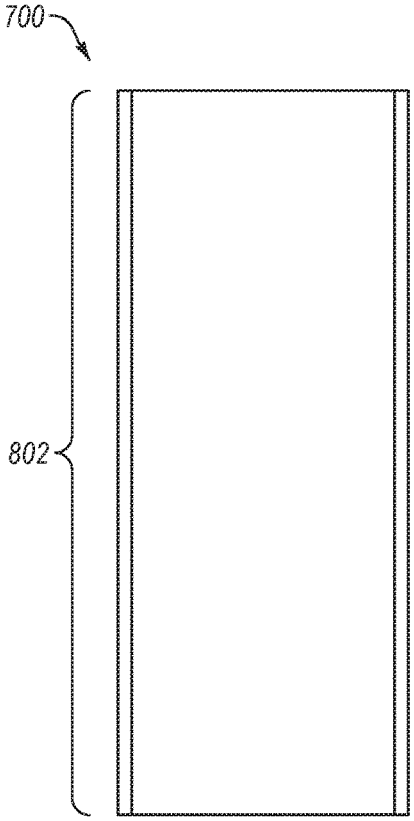
FIG. 8 illustrates an example tower that may be implemented in the base assembly of FIG. 7.

The central structure of the base assembly 700 is the tower 800, an embodiment of which is also depicted in FIG. 8. The tower 800 may include a tubular structure that extends from the tower top plate 1300 to the tower base plate 114. In other embodiments, the tower 800 may be another shape such as rectangular.

The tower 800 supports the tower top plate 1300 relative to the tower base plate 114. For instance, in the depicted embodiment, the tower 800 may have a height 802 of about 36 inches. In other embodiments, the tower 800 may be shorter or longer. For instance, in embodiments in which the vice assembly is attached to a table, the tower may be about twelve inches.

Figure 9:
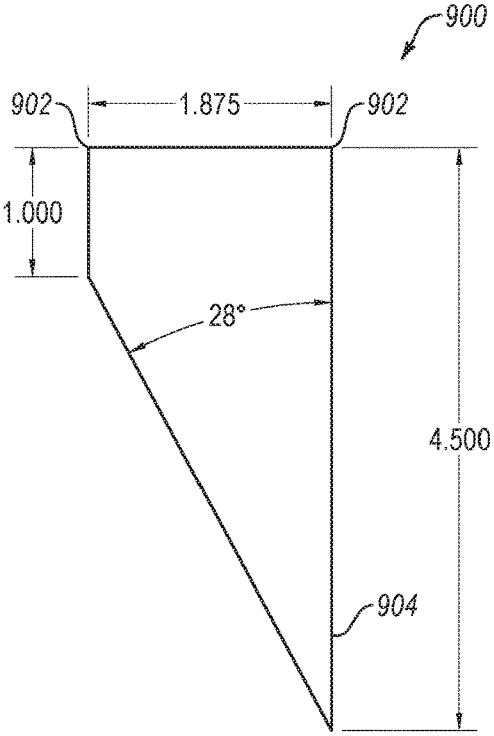
FIG. 9 illustrates an example tower top plate gusset that may be implemented in the base assembly of FIG. 7.

The attachment between the tower 800 and the tower top plate 1300 may be supported by the tower top plate gussets 900, an embodiment of which is depicted in FIG. 9. The tower top plate gussets 900 may include two right angles 902 that abut a bottom surface of the tower top plate 1300. A weld joint may be formed between the right angles 902 and along the bottom surface of the tower top plate 1300. The weld joint may attach the tower top plate gussets 900 to the bottom surface of the tower top plate 1300. Additionally, the tower top plate gussets 900 may include long edge 904 that makes up one of the right angles 902. The long edge 904 may be welded to an outer surface of the tower 800. In the depicted embodiment, the base assembly 700 includes four tower top plate gussets 900 spaced 90 degrees apart. Additionally, in the tower top plate gussets 900, a length between the right angles 902 that is about 41.6% of the length of the long edge 904. In the depicted embodiment, the length between the right angles 902 is about 1.875 inches and the length of the long edge 904 is about 4.5 inches. In other embodiments, the lengths may be different and/or the ratio between the lengths may be maintained. Additionally or alternatively, the base assembly 700 includes more than four or fewer than four tower top plate gussets 900, which may be spaced at any rotational interval.

Figure 10:
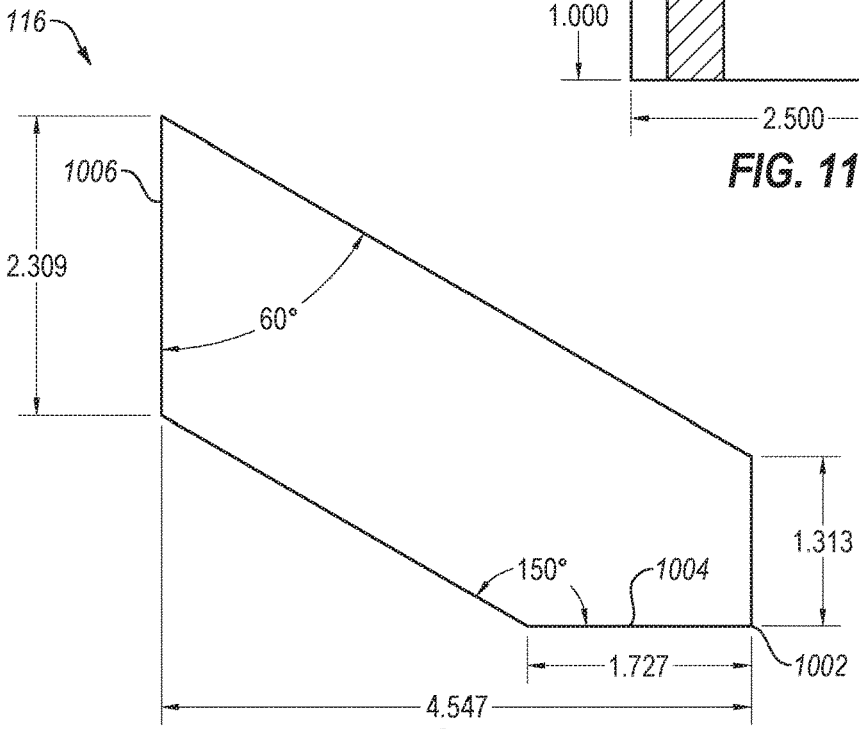
FIG. 10 illustrates an example tower base plate gusset that may be implemented in the base assembly of FIG. 7.

The attachment between the tower 800 and the tower base plate 114 may be supported by the tower base plate gussets 116, an embodiment of which is depicted in FIG. 10. The tower base plate gussets 116 may include a right angle 1002. An edge 1004 that makes up the right angle 1002 may abut a top surface of the tower base plate 114. A weld joint may be formed between the edge 1004 and along the top surface of the tower base plate 114. The weld joint may attach the tower base plate gussets 116 to the top surface of the tower base plate 114.

Additionally, the tower base plate gussets 116 may include an angled edge 1006. The angled edge 1006 may be substantially opposite the right angle 1002. The angled edge 1006 may be welded to the outer surface of the tower 800. In the depicted embodiment, the base assembly 700 includes four tower base plate gussets 116 spaced 90 degrees apart. Additionally, in the tower base plate gussets 116, a length of the edge 1004 may be about 75% of a length of the angled edge 1006. In the depicted embodiment, the length of the edge 1004 may be about 1.727 and the length of the angled edge 1006 may be about 2.309 inches. In other embodiments, the lengths may be different and/or the ratio between the lengths may be maintained. Additionally or alternatively, the base assembly 700 includes more than four or fewer than four tower top plate gussets 900, which may be spaced an any rotational interval.

In some embodiments, the tower base plate gussets 116 and the tower top plate gussets 900 may provide additional capacity to withstand applied forces, provide stability and/or rigidity, and provide additional capacity to withstand general wear and tear and/or accidental abuse to the cylinder vice 100. The tower base plate gussets 116 and the tower top plate gussets 900 may maximize an amount of surface area that may be welded or attached to the tower 800 and/or the tower base plate 114.

Figure 15:
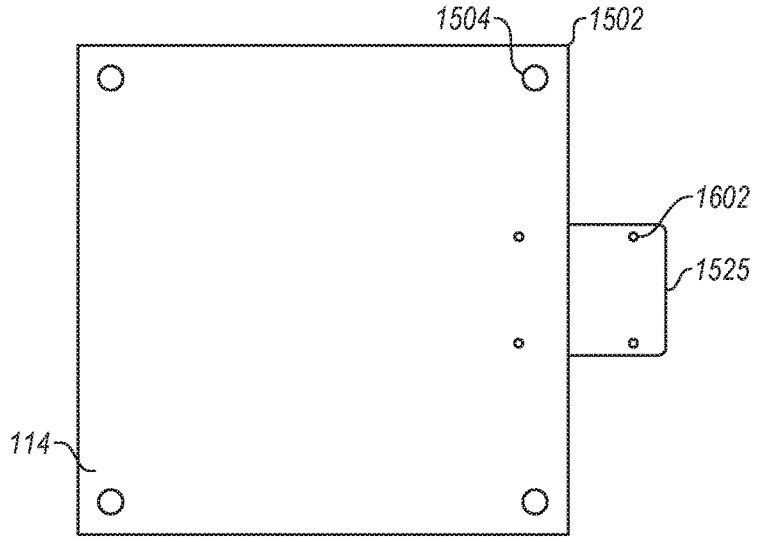
FIG. 15 illustrates an example base plate that may be implemented in the base assembly of FIG. 7.
Figure 16:
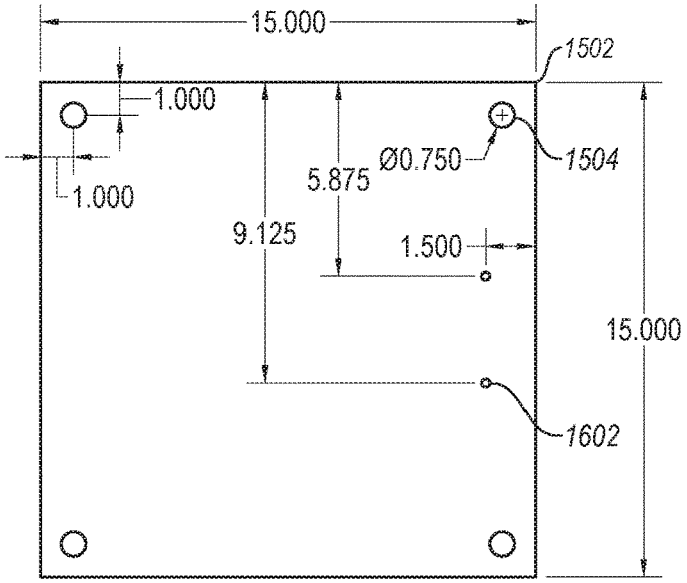
FIG. 16 illustrates a rectangular portion of tower base plate of FIG. 15.
Figure 17:
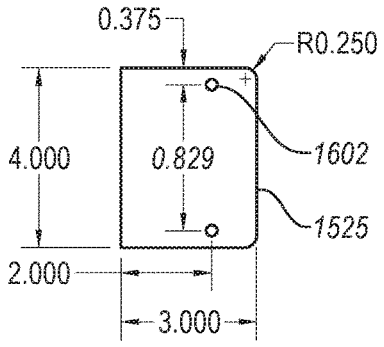
FIG. 17 illustrates an example pump mount that may be implemented in the base plate of FIG. 15.

The tower base plate 114, an embodiment of which is depicted in FIGS. 15-17, may be substantially rectangular. At each corner 1502 a hole 1504 may be defined. The hole 1504 may be used to attach the tower base plate 114 to the floor or another surface. For instance, bolts may extend through the holes to attach the tower base plate 114 to the floor.

In some embodiments, a bottom surface of the tower base plate 114 may be altered (e.g., via grinding, finishing, or smoothing) to ensure the tower base plate 114 is flush with the ground. Alteration of the bottom surface of the tower base plate 114 may reduce or alleviate non-level portions that may lead to instability in a cylinder vice (e.g., 100).

In some embodiment, the tower base plate 114 may include a pump mount 1525 (FIGS. 15 and 17). The pump mount 1525 may be configured to support a pump base that may be included in a hydraulic assembly such as the hydraulic assembly 2400. The pump mount 1525 may include a rectangular plate that may be smaller than the tower base plate 114. The pump mount 1525 may be attached to the tower base plate 114 between two of the corners 1502. For instance, the pump mount 1525 may be welded to the tower base plate 114.

The tower base plate 114 and the pump mount 1525 may define mount holes 1602. The mount holes 1602 may be tapped. Accordingly, bolts may be threaded into the mount holes 1602 to secure the pump base relative to the tower base plate 114. FIGS. 15, 16, and 17 include example dimensions for at least one embodiment of the tower base plate 114 and the pump mount 1525. For instance, the tower base plate 114 of FIGS. 15 and 16 is a 15 inch by 15 inch square with the holes 1504 defined about 1.41 inches from the corners 1502. The pump mount 1525 may be four inches by three inches. In other embodiments, the dimensions of the tower base plate 114 and/or the pump mount 1525 may differ. For instance, the tower base plate 114 may be circular or rectangular.

Figure 11:
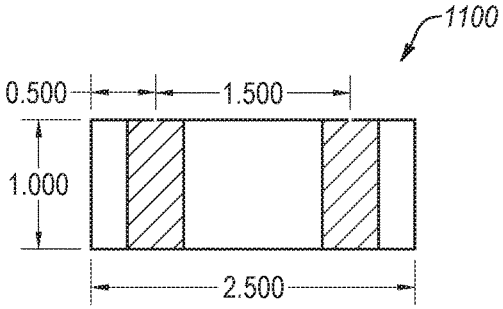
FIG. 11 illustrates an example retainer clamp that may be implemented in the base assembly of FIG. 7.
Figure 13:
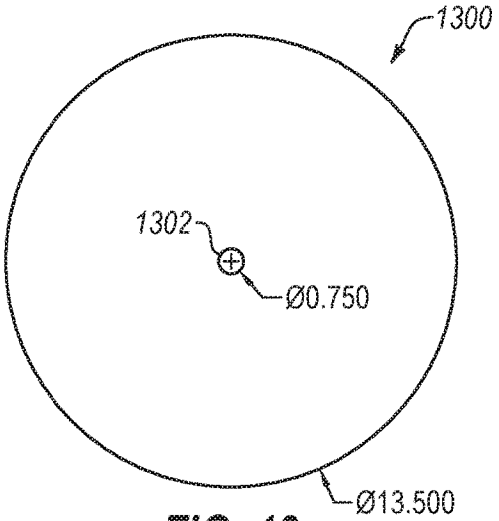
FIG. 13 illustrates an example tower top plate that may be implemented in the base assembly of FIG. 7.

The base assembly 700 may also include the tower top plate 1300 and a retainer clamp 1100. An example of the retainer clamp 1100 is depicted in FIG. 11. An example embodiment of the tower top plate 1300 is depicted in FIG. 13. The tower top plate 1300 defines a central hole 1302 and a plate diameter 1304. The plate diameter 1304 may be about 13.5 inches.

With combined reference to FIGS. 11-14, the tower top plate 1300 is rotationally attached to a vice base plate 550. For example, the vice base plate 550 may swivel or rotate relative to the tower top plate 1300. Thus, the vice base plate 550 may be configured to swivel, while the tower top plate 1300 remains stationary, such that different angular configurations of the cylinder vice 100 may be achieved. In some embodiments, different angular configurations of the cylinder vice 100 may be desirable to utilize available space, for compatibility with other tools and equipment, and/or the ability to accomplish different tasks at different stages when working on the cylindrical structure (e.g., 50). The tower top plate 1300 may be sized to fit against a bottom surface of the vice base plate 550 and within the retainer ring 560. The retainer ring 560 may be configured to limit or prevent lateral movement other than rotation of the vice base plate 550 relative to the tower top plate 1300. The retainer ring 560 may serve to prevent, during its rotation, the vice base plate 550 from sliding away from a central axis of the tower 800, which may create a misalignment between the vice assembly 500 and the base assembly 700.

The retainer clamps 1100 may be employed to fix the vice base plate 550 and the retainer ring 560 to the tower top plate 1300. The retainer clamp 1100 in some embodiments may not be a permanent means of attachment, but rather removable as desired. The retainer clamp 1100 may include a nut and bolt type of fastener or another fastening mechanism such as a fastener or clamp. The base assembly 700 may include multiple retainer clamps 1100 positioned in a multi-point, equal-distance configuration. The retainer clamps 1100 may be configured to correspond to the perimeter holes 1206. Accordingly, the nut and bolt may be positioned in the retainer clamps 1100 and through the perimeter holes 1206.

Figure 18A:
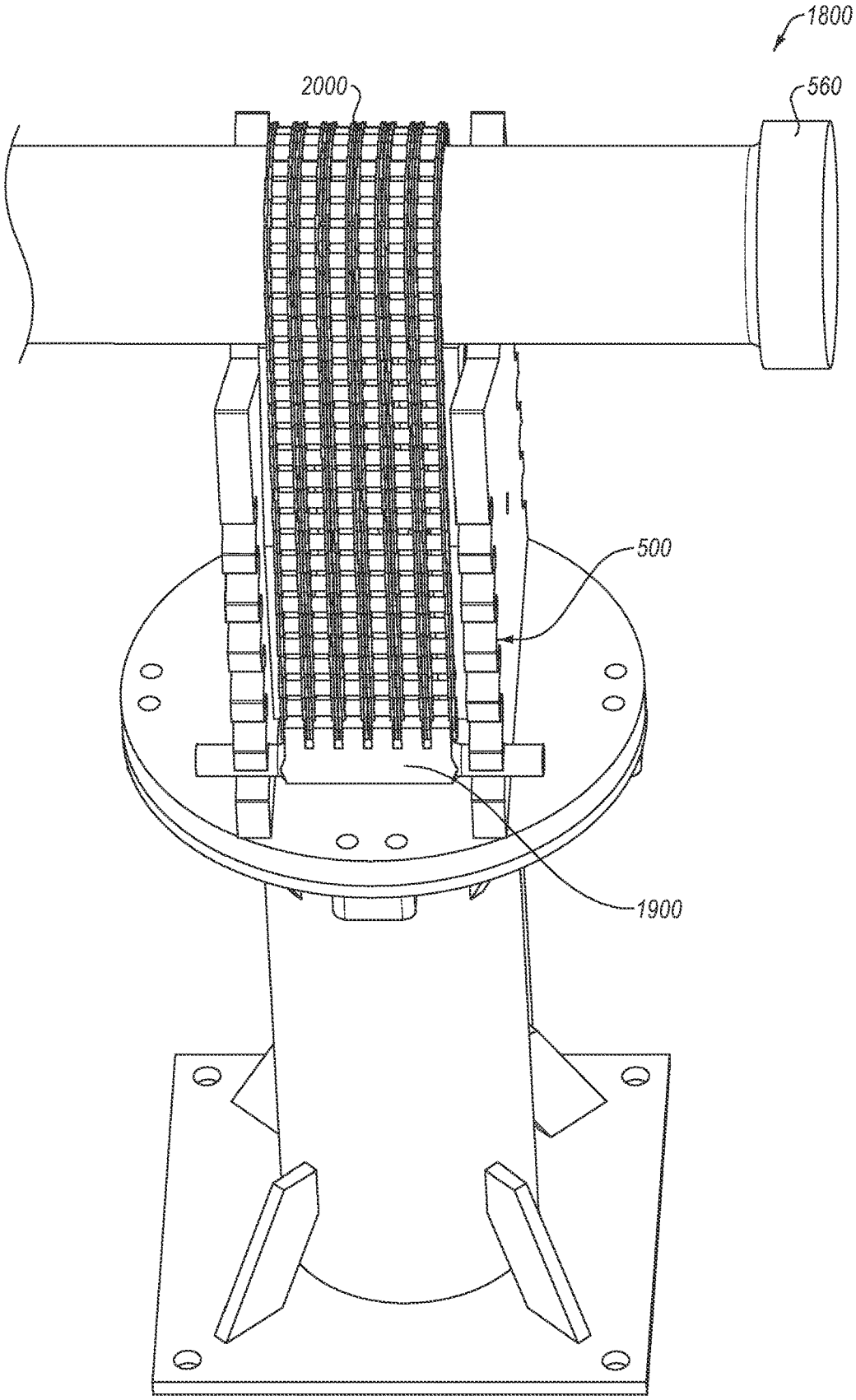
FIG. 18A is an image of an example chain assembly that may be implemented in the cylinder vice of FIGS. 1A-1D.
Figure 18B:
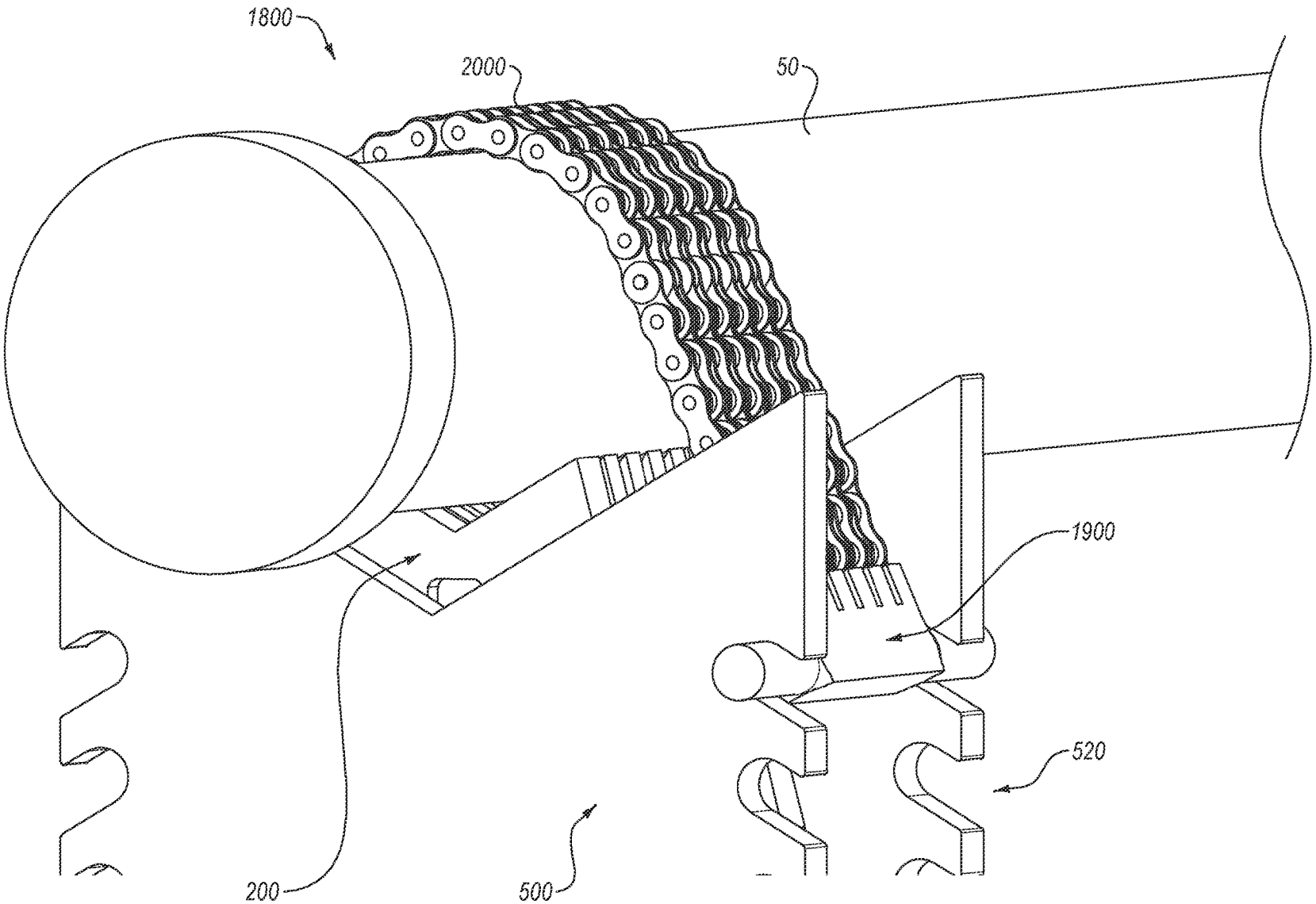
FIG. 18B is an image of another view of the chain assembly of FIG. 18A.
Figure 18C:
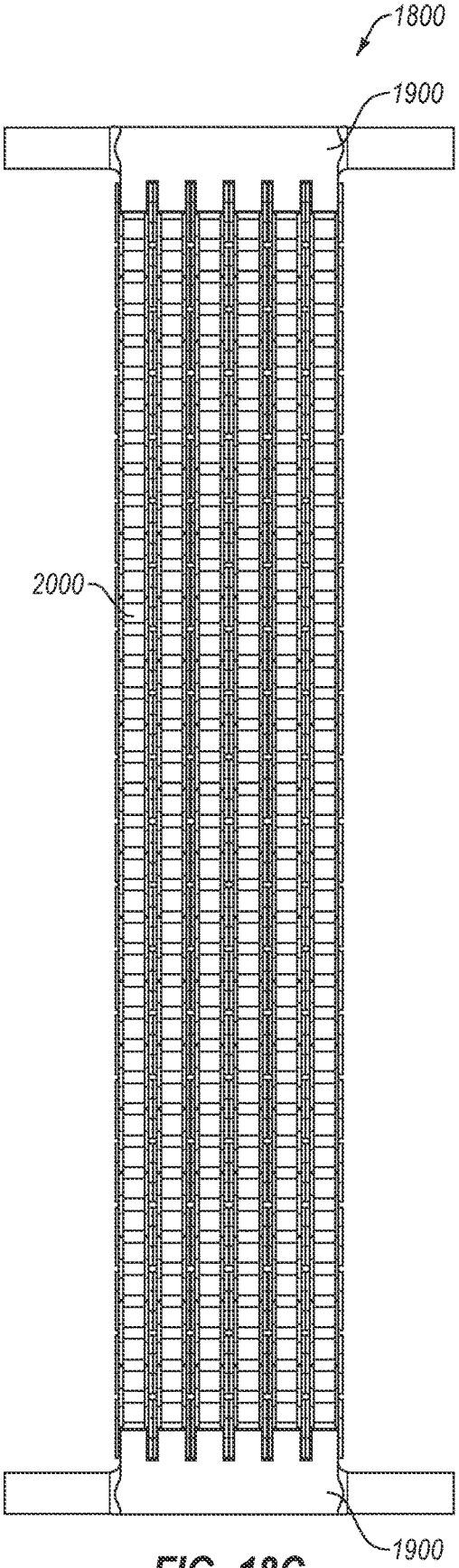
FIG. 18C is an image of another view of the chain assembly of FIG. 18A.
Figure 18D:
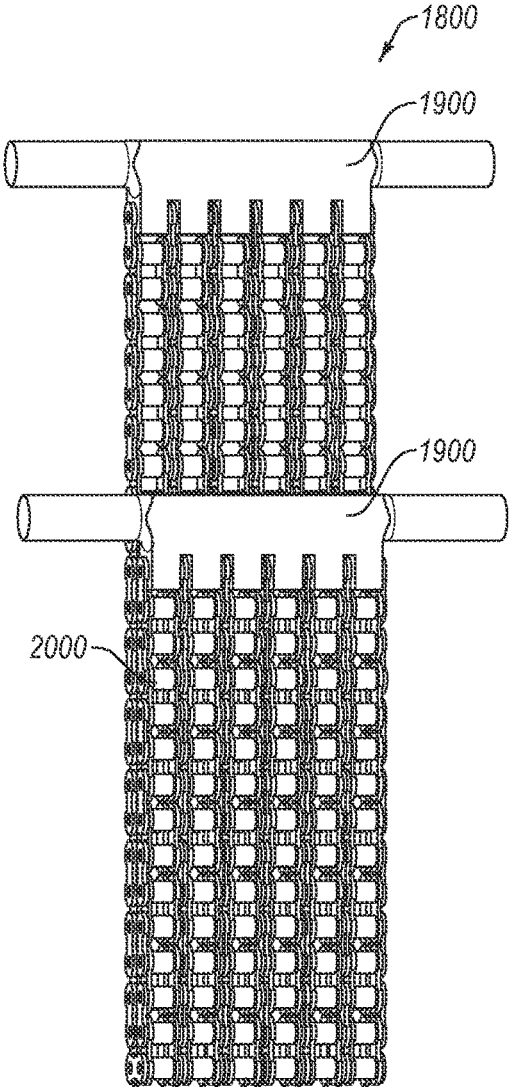
FIG. 18D is an image of another view of the chain assembly of FIG. 18A.
Figure 18E:
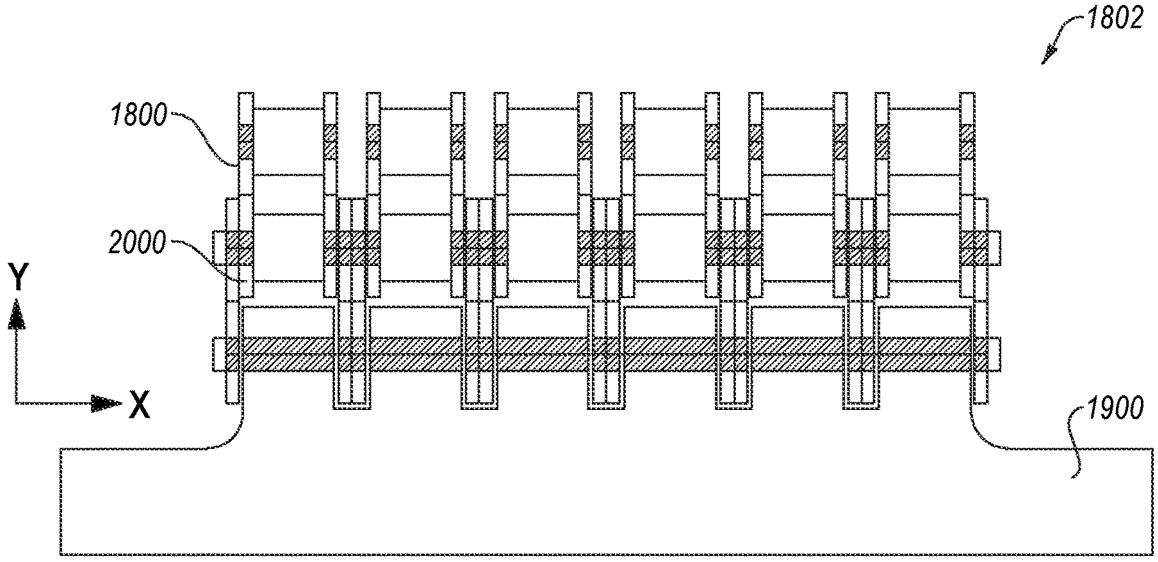
FIG. 18E is a diagram of another view of the chain assembly of FIG. 18A.

FIG. 18A-18E illustrates an example embodiment of the chain assembly 1800 that may be implemented in the cylinder vice 100 of FIGS. 1A-1D. FIG. 18A is an upper perspective image of the chain assembly 1800 interfaced with the vice assembly 500 and retaining the cylindrical structure 50. FIG. 18B is another perspective image of the chain assembly 1800 interfaced with the vice assembly 500 and retaining the cylindrical structure 50 with the jaw assembly 200. FIG. 18C is an image of the chain assembly 1800 laid out. FIG. 18D is an image of the chain assembly 1800 folded on itself. FIG. 18E is an end view of the chain assembly 1800.

The chain assembly 1800 may include a chain 2000 that is attached at each end to chain retainers 1900. The chain retainers 1900 may be configured to be retained in notches defined in a vice assembly. For example, with reference to FIGS. 18A and 18B, the chain retainers 1900 may be retained in the notches 520. In particular, a first of the chain retainers 1900 may be positioned in one of the notches 520 on a first side of the vice assembly 500. A second of the chain retainers 1900 may be positioned in a second of the notches 520 on a second side of the vice assembly 500. The chain 2000 may be routed through the volume 512, up and over the cylindrical structure 50. Accordingly, a central portion of the chain 2000 may contact an outer surface of the cylindrical structure 50.

With reference to FIGS. 18B and 18E, the jaw assembly 200 may be translated towards the cylindrical structure 50 to press the cylindrical structure 50 against the central portion of the chain 2000. The chain assembly 1800 is held relative to the vice assembly 500 because of the chain retainers 1900 being retained in the notches 520. FIG. 18E depicts an end 1802 of the chain assembly 1800. The end 1802 may include the chain retainer 1900 attached to the chain 2000. A portion of the chain retainer 1900 extends in an x-direction and a negative x-direction from the chain 2000. The portion of the chain retainer 1900 that extends from the chain 2000 is positioned in the notches 520 and is retained therein. Thus, when the jaw assembly 200 moves the cylindrical structure 50 upwards, the chain assembly 1800 limits the upwards displacement of the cylindrical structure 50. At the upper limit of displacement, the cylindrical structure 50 may be substantially fixed.

In the embodiment depicted in FIGS. 18A-18E, the chain assembly 1800 includes two chain retainers 1900 that are substantially identical. One of the chain retainers 1900 is positioned on each end of the chain 2000. In other embodiments, the chain assembly 1800 may be fixed on one end to the vice assembly 500. In these and other embodiments, the chain assembly 1800 may include a single chain retainer 1900. Additionally, in the depicted embodiment, the chain assembly 1800 includes the chain 2000 that extends an entire length between the chain retainers 1900. In other embodiments, the chain 2000 may extend a portion of the length between the chain retainers 1900.

Figure 19A:
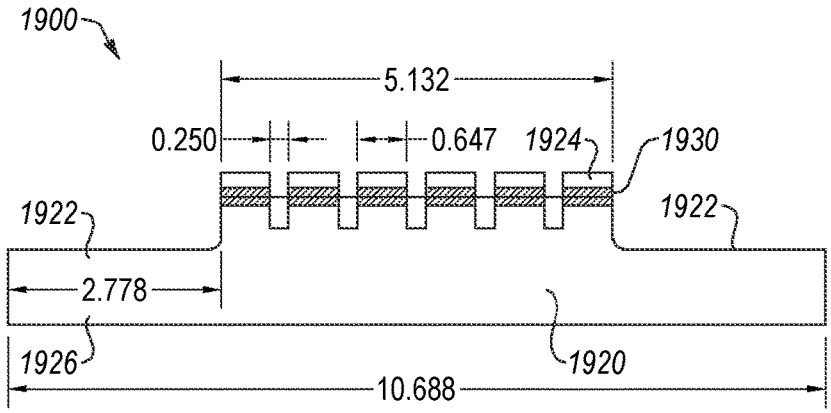
FIG. 19A illustrates an example chain retainer that may be implemented in the chain assembly of FIGS. 18A-18E.
Figure 19B:
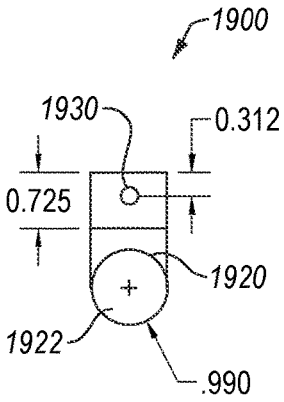
FIG. 19B is another view of the chain retainer of FIG. 19A.
Figure 19C:
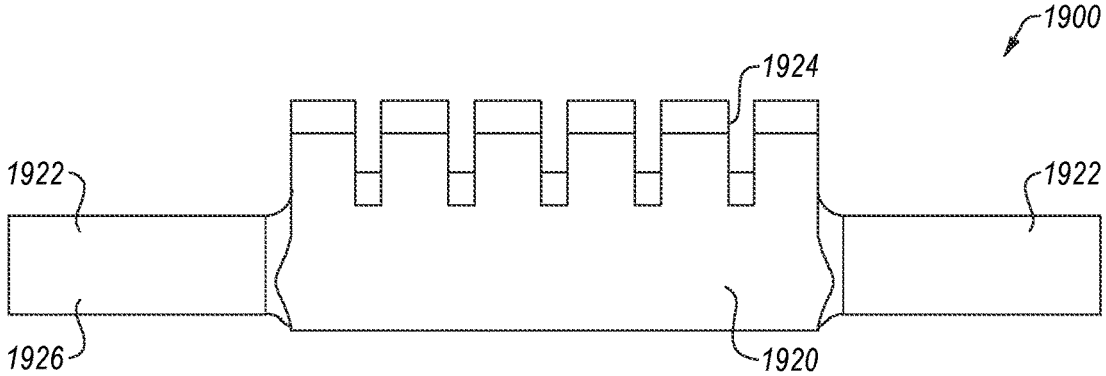
FIG. 19C is an image of an example chain retainer such as the chain retainer of FIG. 19A.

FIGS. 19A-19C illustrate an example embodiment of the chain retainer 1900 that may be implemented in the chain assembly 1800 of FIGS. 18A-18E. FIG. 19A depicts a side view of the chain retainer 1900. FIG. 19B depicts an end view of the chain retainer 1900. FIG. 19C is an image of the chain retainer 1900.

The chain retainer 1900 may include a central portion 1920 that is positioned between two retainer handles 1922. The central portion 1920 may define a set of slots 1924. The slots 1924 may be configured to receive a final set of links in a chain (e.g., the chain 2000). The central portion 1920 may further define an opening 1930 laterally in the slots 1924. A pin may be positioned in the opening 1930 to hold the set of links in the chain relative to the chain retainer 1900. In the embodiment of FIGS. 19A-19C, five slots 1924 are defined in the central portion 1920. In other embodiments, less than five slots 1924 or more than five slots 1924 may be defined in the central portion 1920 based upon the chain and the number of links in the final set of links.

The retainer handles 1922 may extend from the central portion 1920. The retainer handles 1922 or a portion thereof may be configured to be retained in notches defined in a vice assembly. Additionally, the retainer handles 1922 may include a length 1926 that is greater than a width of side braces included in the vice assembly. In some embodiments, the retainer handles 1922 may function as an anchor to the chain 2000. In these or other embodiments, the retainer handles 1922 temporarily fix the chain retainer 1900 at a specific location, particularly in two notches at equal heights in the plurality of notches 520. Which notches a user may choose among the plurality of notches 520 may correspond to a size of the cylindrical structure, a length of the chain 2000, and/or a desired amount of surface area contact between the cylindrical structure and the chain 2000. In some embodiments, the retainer handles 1922 are elongated such that the retainer handles 1922 extend beyond the side braces 510. This configuration of the retainer handles 1922 may permit easy relocation or moving of the chain retainer 1900. In other embodiments, the elongated configuration of the retainer handles 1922 may function as a safety feature to prevent loss of digits or other bodily injury.

For example, with reference to FIGS. 5B and 19A, the retainer handles 1922 may have a length 1926 that is greater than the side braces 510. Accordingly, when the retainer handles 1922 are received in the notches 520, a portion of the retainer handles 1922 may extend from the side braces 510 and be accessible from outside of the vice assembly 500.

Referring back to FIGS. 19A-19C, the retainer handles 1922 of the depicted embodiment are cylindrical. In other embodiments, the retainer handles 1922 may include a cylindrical portion or may have another shape that is configured to be retained in the notches.

In the embodiment of FIGS. 19A-19C, the slots 1924 may include a width of about 0.25 inches and the slots may be separated by about 0.647 inches. In other embodiments, the width of the slots 1924 may differ based upon dimension of the chain 2000. The chain 2000 may include a 60-6 roller chain or another type of roller chain.

Figure 20A:
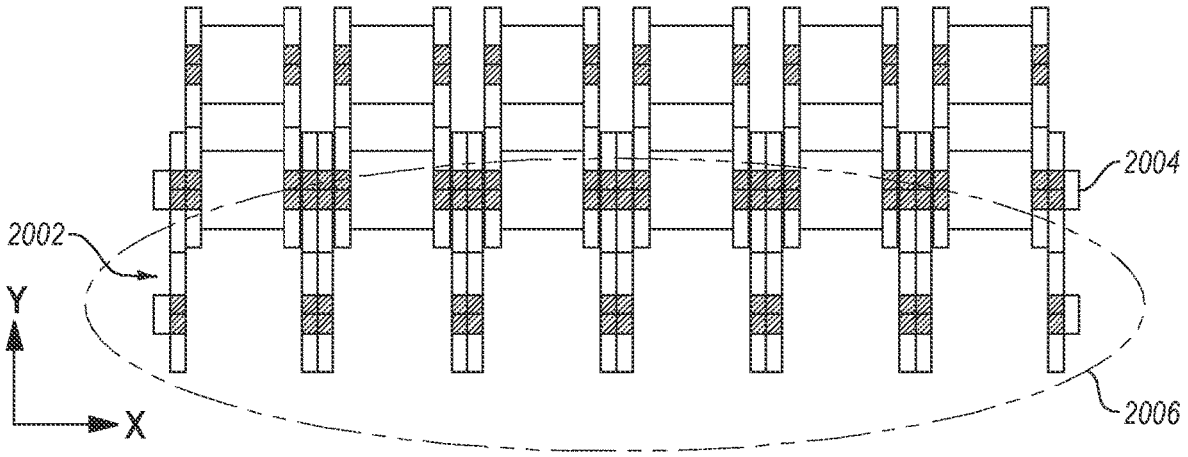
FIG. 20A illustrates a portion of an example chain that may be implemented in the chain assembly of FIGS. 18A-18E.
Figure 20B:
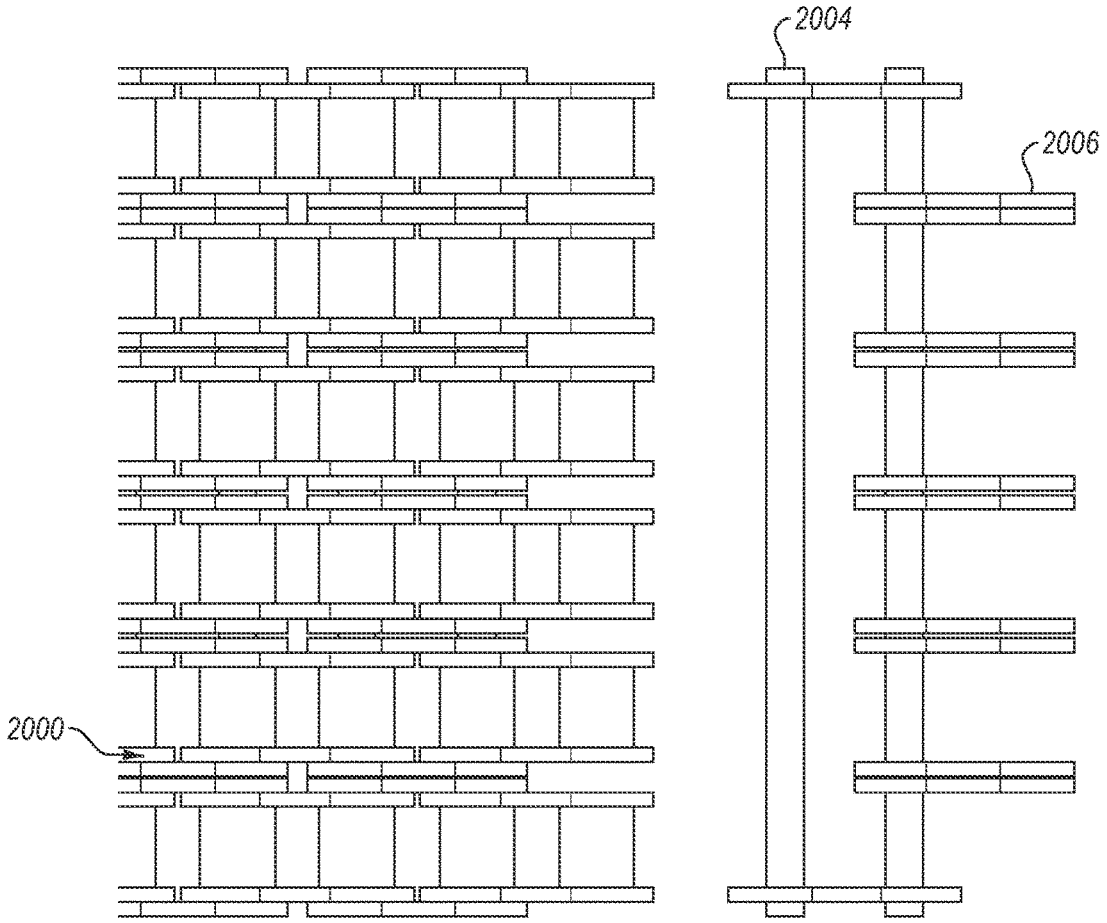
FIG. 20B is an image of a portion of an example chain that may be implemented in the chain assembly of FIGS. 18A-18E.

FIGS. 20A and 20B illustrate an example embodiment of a portion of the chain 2000 that may be implemented in the chain assembly 1800 of FIGS. 18A-18E. FIG. 20A depicts a diagram of the portion of the claim 2000 and FIG. 20B is an image of the portion of the chain 2000. The chain 2000 may be configured to have a particular amount of surface area contact with a cylindrical structure. For example, the chain 2000 may contact only an upper most portion of the cylindrical structure or may contact more than a tangential portion of the cylindrical structure (e.g., wrap around a portion of the cylindrical structure).

The chain 2000 may include multiple links 2002. The multiple links 2002 may extend in the x-direction and the y-direction. For instance, the links 2002 may be connected to one or more other links along an axis 2004 that extends laterally in rows of links 2002. Additionally, each of the rows of links 2002 may be connection to another row of links 2002 to make up the chain 2000.

The chain 2000 includes a final set of links 2006. The final set of links may be configured to connect to a retainer handle such as the retainer handles 1922 of FIGS. 19A-19C. In some embodiments of the chain, there may be two final sets of links 2006, one on each end. In other embodiments, only one end may include one final set of links 2006.

In some embodiments, the chain 2000 may have a length of between about 2 feet and about 4 feet, which may be fixed. In other embodiments, the chain 2000 may have a little slack when substantially fixed to a vice assembly such as the vice assembly 500.

Figure 21A:
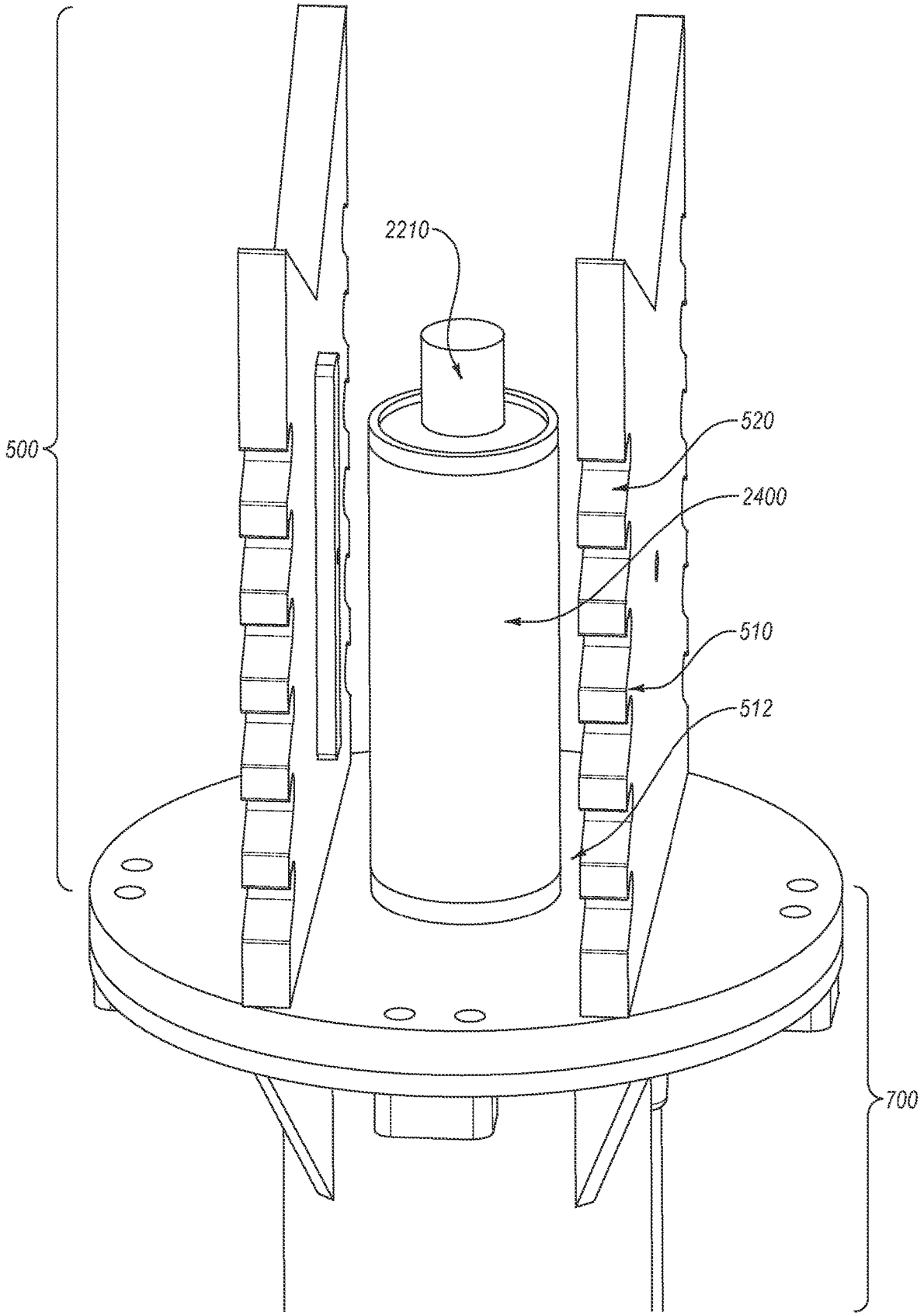
FIG. 21A is an image of a portion of an example hydraulic assembly that may be implemented in the cylinder vice of FIGS. 1A-1D.
Figure 21B:
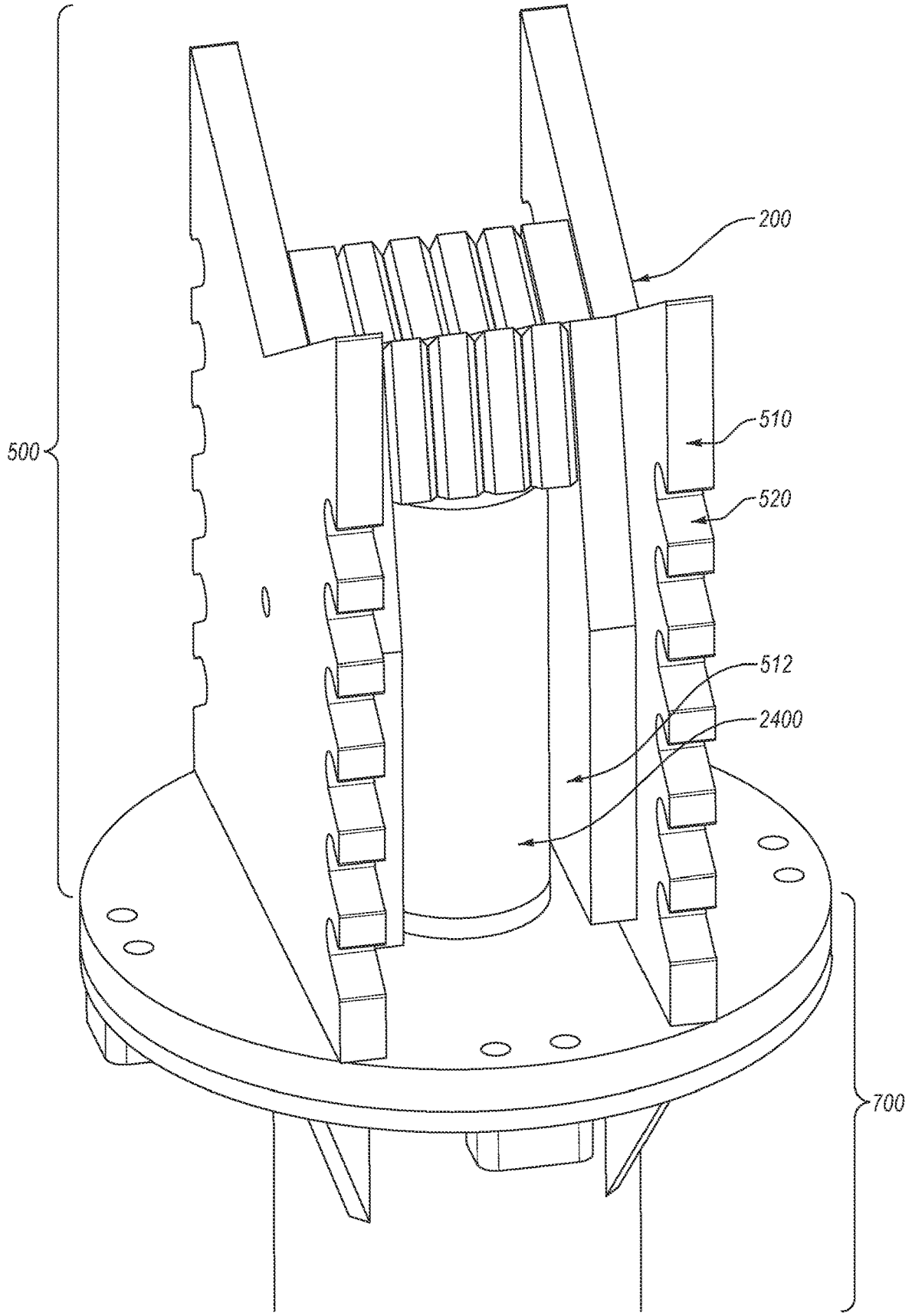
FIG. 21B is another image of another portion of an example hydraulic assembly of FIG. 21A.
Figure 21C:
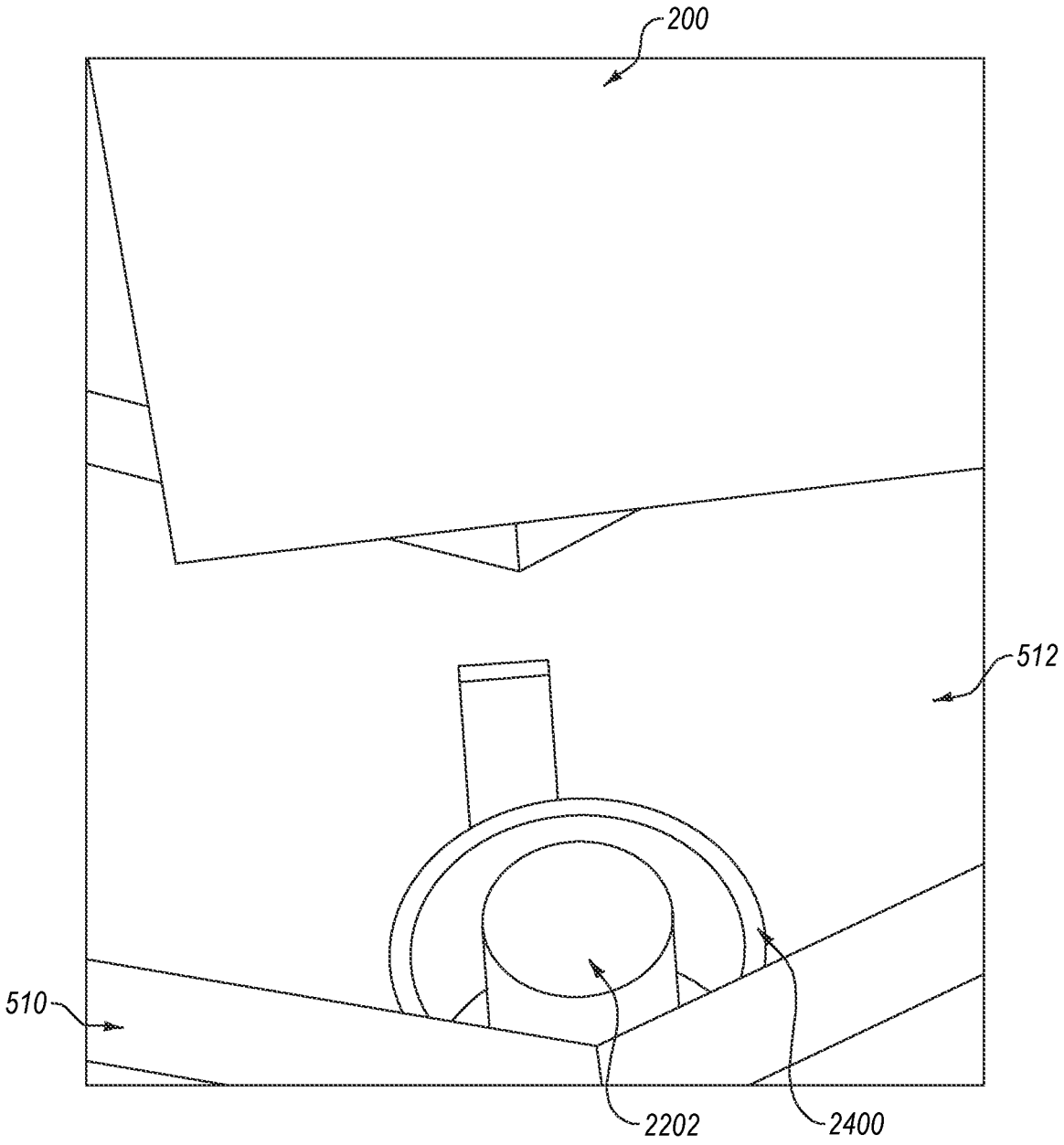
FIG. 21C is another image of another portion of an example hydraulic assembly of FIG. 21A.
Figure 21D:
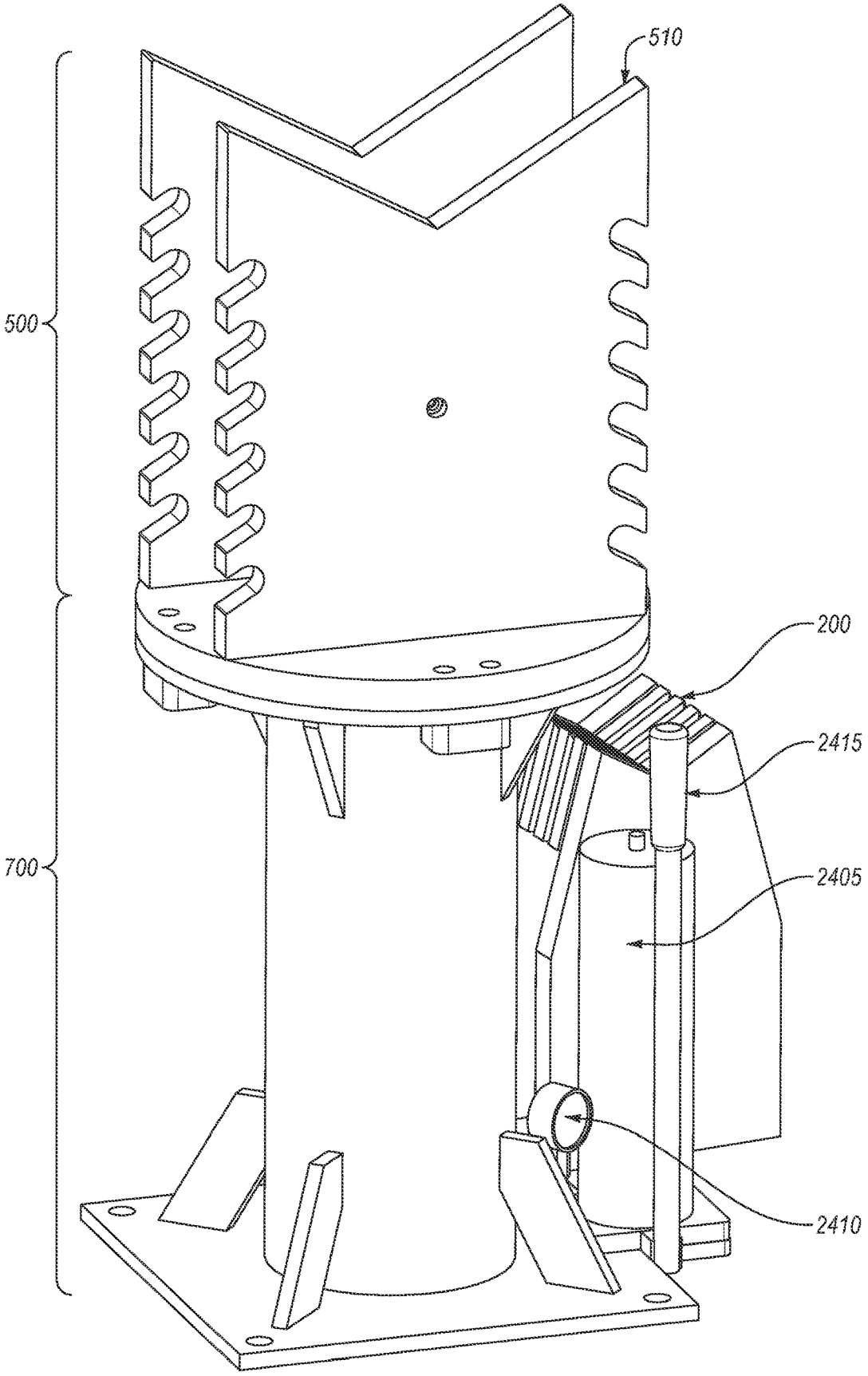
FIG. 21D is another image of another portion of an example hydraulic assembly of FIG. 21A.

FIGS. 21A-21C illustrate an example hydraulic assembly 2400 that may be implemented with the cylinder vice 100 of FIGS. 1A-1D. FIG. 21A is an image of a piston housing 2200 attached to the vice assembly 500 and positioned in the volume 512. FIG. 21B is an image of the jaw assembly 200 positioned in the volume 512 and over the piston housing 2200. FIG. 21C depicts a piston head 2202 of a piston 2210 positioned in the volume 512 with the jaw assembly 200 removed from the volume 512. FIG. 21D is an image of the vice assembly 500 and the base assembly 700 with a pump 2405 that is included in the hydraulic assembly 2400. In FIG. 21D, the jaw assembly 200 is on the floor next to the base assembly 700.

The piston housing 2200 may encompass or substantially encompass the piston 2210. The piston housing 2200 and piston 2210 may be positioned directly below the jaw assembly 200 and between the side braces 510. In this manner, when a user pumps a pump handle 2415 on the pump 2405, the piston 2210 is actuated upwards towards the jaw assembly 200 and outwards from the piston housing 2200 until directly abutting the jaw assembly 200. With additional pumping of the pump handle 2415, the piston 2210 may proceed upwards, thereby driving the jaw assembly 200 into the cylindrical structure (e.g., 50 of FIG. 1D). The cylindrical structure may then be pinned between the jaw assembly 200 and a chain assembly such as the chain assembly 1800 described herein.

In the depicted embodiment, the pump 2405 includes the pump handle 2415. In other embodiments, the pump 2405 may be actuated by a non-manual mechanism (electrical, pneumatic, etc.). In some embodiments, the pump 2405 may include a pressure gauge 2410. The pressure gauge 2410 may enable a user to monitor an applied pressure, which may reduce the likelihood that the cylindrical structure is deformed or compressed in the cylinder vice. The pressure gauge 2410 may be configured for about 3000 pounds per square inch (psi) in some embodiments. Different applications, types of cylindrical structures, etc. may require more or less hydraulic pressure as required to ensure adequate holding or fixation of the cylindrical structure or other item.

Figure 22:
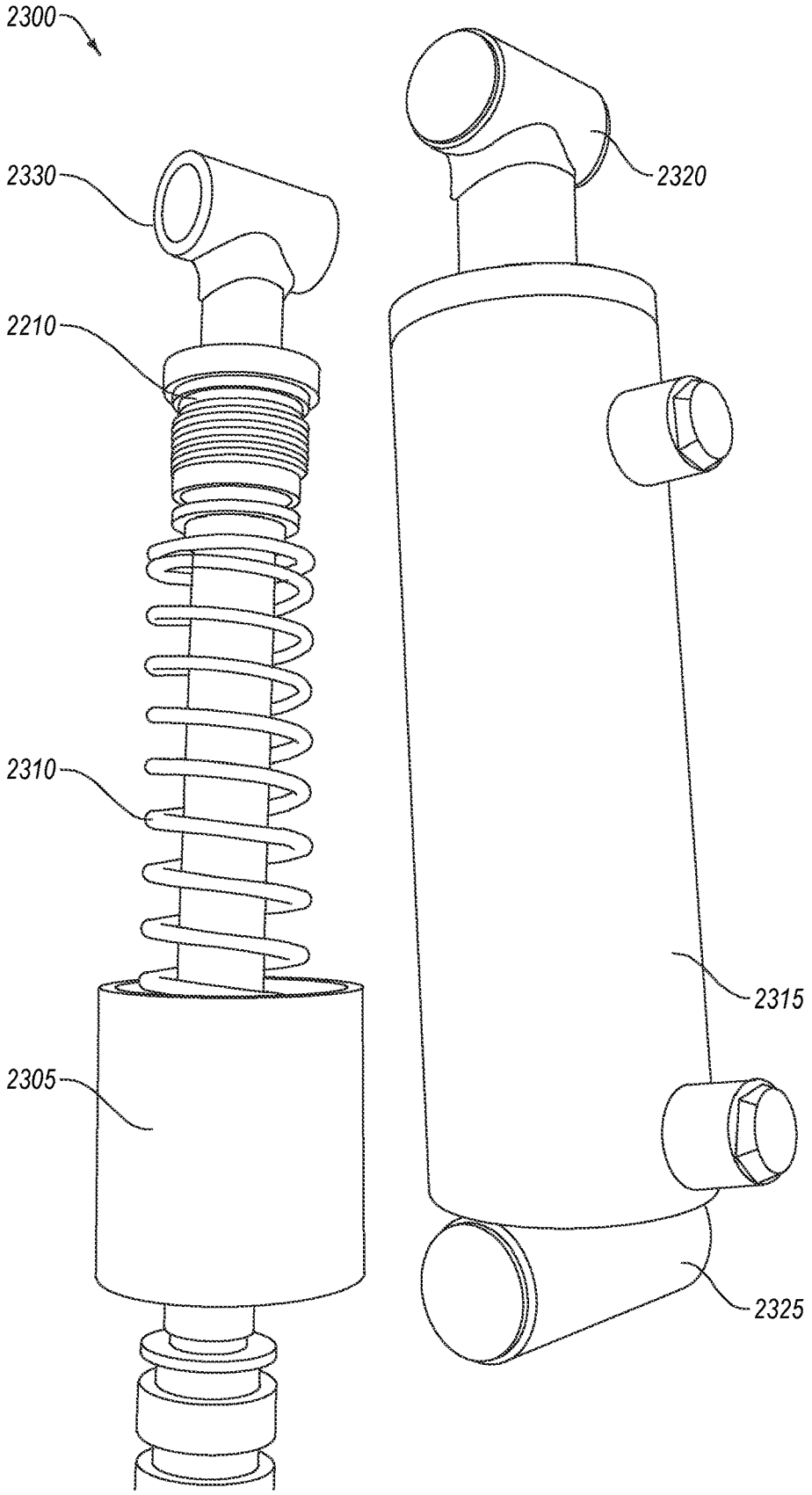
FIG. 22 illustrates example components that may be modified to produce the vice piston assembly that may be implemented in the hydraulic assembly of FIGS. 21A-21D, all arranged in accordance with at least one embodiment of the present disclosure.

FIG. 22 is an image of components 2300 that may be used to construct the piston housing 2200 of FIGS. 21A-21B. The components 2300 may include a limiter 2305, the piston 2210, a spring 2310, and a housing 2315. An old piston 2320 may be removed from the housing 2315. Additionally, a lower fitting 2325 may be cut from the housing 2315. An upper fitting 2330 may be removed from the piston 2210. The spring 2310 and the limiter 2305 may be assembled in the housing 2315.

The limiter 2305 may limit the stroke of the piston 2210 of the assembled piston housing 2200. The spring 2310 may be configured to return the piston 2210 to an unactuated position.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

All examples and conditional language recited herein are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, it should be understood that the various changes, substitutions, and alterations could be made hereto without departing from the spirit and scope of the present disclosure.

What is claimed is:

1. A cylinder vice comprising:

a tower, the tower configured to be fixed at a bottom side to a base plate, and the tower configured to be fixed at a top side to a top plate;

a first plurality of gussets configured to attach a bottom portion of the tower to the base plate;

a second plurality of gussets configured to attach a top portion of the tower to the top plate;

a retainer ring configured to be positioned concentric to the top plate;

a vice plate, the vice plate configured to be positioned above the retainer ring and the top plate, and the vice plate configured to be fastened to the retainer ring and the top plate when fastened with a retainer clamp, and the vice plate configured to swivel about a central axis of the tower when not fastened with the retainer clamp to the retainer ring and the top plate;

side braces, wherein the side braces include:

a male slide on each internal face of the side braces;

a plurality of notches on each side edge of the side braces, each notch of the plurality of notches angled downward and including a radial face; and a top edge on each of the side braces, the top edge having a first V-shape geometry such that a cylindrical structure is permitted to rest on the top edge without movement;

a vice jaw, the vice jaw positioned between the side braces and including outer plates and inner plates;

wherein the outer plates include a top edge having a second V-shape geometry, and wherein each of the outer plates includes a female slide configured to interface with the corresponding male slide of the side braces;

wherein the inner plates include a top edge having a third V-shape geometry, and wherein the inner plates include a bottom edge that is configured to interface with a piston, the bottom edge substantially perpendicular to the piston; and wherein the second V-shape geometry and the third V-shape geometry are symmetrical relative to each other;

a chain retainer configured to retain a chain end of a chain, the chain end positioned in a slot configuration of the chain retainer and fastened to the chain retainer via retainer handles, and the chain retainer including a handle on each side of the slot configuration such that each handle is configured to be positioned in one of the notches of the side braces; and a hydraulic assembly, wherein the hydraulic assembly is configured to actuate the piston against the bottom edge of the inner plates of the vice jaw such that the vice jaw applies a positive amount of work to the cylindrical structure, the cylindrical structure configured to be simultaneously bound on a top portion by the chain; and wherein the hydraulic assembly includes a spring and a limiter, the spring configured to aid the piston to return to a beginning of a piston stroke, and the limiter configured to limit the piston stroke.

* * * * *